US009840751B2

(12) United States Patent
Hayashi et al.

(10) Patent No.: US 9,840,751 B2
(45) Date of Patent: Dec. 12, 2017

(54) METHOD FOR MANUFACTURING HOT STAMPED BODY AND HOT STAMPED BODY

(71) Applicant: NIPPON STEEL & SUMITOMO METAL CORPORATION, Tokyo (JP)

(72) Inventors: Kunio Hayashi, Tokyo (JP); Toshimitsu Aso, Tokyo (JP); Toshimasa Tomokiyo, Tokyo (JP); Hitoshi Tanino, Toyota (JP); Ryozo Wada, Obu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/422,520

(22) Filed: Feb. 2, 2017

(65) Prior Publication Data

US 2017/0145531 A1 May 25, 2017

Related U.S. Application Data

(62) Division of application No. 13/879,061, filed as application No. PCT/JP2011/074297 on Oct. 21, 2011, now Pat. No. 9,598,745.

(30) Foreign Application Priority Data

Oct. 22, 2010 (JP) ..... 2010-237249
Dec. 27, 2010 (JP) ..... 2010-289527

(51) Int. Cl.
*C22C 38/28* (2006.01)
*C21D 9/00* (2006.01)
(Continued)

(52) U.S. Cl.
CPC ..... *C21D 9/0068* (2013.01); *B21D 22/022* (2013.01); *C21D 8/005* (2013.01);
(Continued)

(58) Field of Classification Search
CPC ..... C22C 38/28; C21D 8/02; C21D 8/0263
(Continued)

(56) References Cited

U.S. PATENT DOCUMENTS

2007/0029015 A1 2/2007 Yoshinaga et al.
2008/0202639 A1 8/2008 Tomida et al.
2013/0199676 A1 8/2013 Tomokiyo et al.

FOREIGN PATENT DOCUMENTS

CN 100999775 A 7/2007
CN 101297049 A 10/2008
(Continued)

OTHER PUBLICATIONS

U.S. Office Action for U.S. Appl. No. 13/879,049, dated Feb. 11, 2016.
(Continued)

*Primary Examiner* — Brian Walck
(74) *Attorney, Agent, or Firm* — Birch, Stewart, Kolasch & Birch, LLP

(57) ABSTRACT

Provided is a method for manufacturing a hot stamped body, the method including: a hot-rolling step; a coiling step; a cold-rolling step; a continuous annealing step; and a hot stamping step, in which the continuous annealing step includes a heating step of heating the cold-rolled steel sheet to a temperature range of equal to or higher than $Ac_1$° C. and lower than $Ac_3$° C.; a cooling step of cooling the heated cold-rolled steel sheet from the highest heating temperature to 660° C. at a cooling rate of equal to or less than 10° C./s; and a holding step of holding the cooled cold-rolled steel sheet in a temperature range of 550° C. to 660° C. for one minute to 10 minutes.

1 Claim, 7 Drawing Sheets

(51) Int. Cl.

| | |
|---|---|
| ***C22C 38/58*** | (2006.01) |
| ***C22C 38/54*** | (2006.01) |
| ***C22C 38/50*** | (2006.01) |
| ***C22C 38/48*** | (2006.01) |
| ***C22C 38/42*** | (2006.01) |
| ***C22C 38/38*** | (2006.01) |
| ***C22C 38/32*** | (2006.01) |
| ***C22C 38/26*** | (2006.01) |
| ***C22C 38/24*** | (2006.01) |
| ***C22C 38/22*** | (2006.01) |
| ***C22C 38/20*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 8/00*** | (2006.01) |
| ***B21D 22/02*** | (2006.01) |

(52) U.S. Cl.

CPC ..... *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/42* (2013.01); *C22C 38/48* (2013.01); *C22C 38/50* (2013.01); *C22C 38/54* (2013.01); *C22C 38/58* (2013.01)

(58) Field of Classification Search

USPC ..... 148/330, 333, 603

See application file for complete search history.

(56) References Cited

FOREIGN PATENT DOCUMENTS

| | | | | |
|---|---|---|---|---|
| CN | 101326299 | A | 12/2008 | |
| CN | 101365819 | A | 2/2009 | |
| JP | 2002-053935 | A | 2/2002 | |
| JP | 2005-240175 | A | 9/2005 | |
| JP | 2006-193805 | A | 7/2006 | |
| JP | 2006-200020 | A | 8/2006 | |
| JP | 2006-265583 | A | 10/2006 | |
| JP | 2007-162078 | A | 6/2007 | |
| JP | 2007-314817 | A | 12/2007 | |
| JP | 2008-308732 | A | 12/2008 | |
| JP | 2009-185355 | A | 8/2009 | |
| JP | 2009-270126 | A | 11/2009 | |
| JP | 2009-274122 | A | 11/2009 | |
| JP | 2010-209392 | A | 9/2010 | |
| JP | 2010-215954 | A | 9/2010 | |
| JP | 2011-152589 | A | 8/2011 | |
| JP | 5224010 | B2 | 7/2013 | |
| JP | 2013-151708 | A | 8/2013 | |
| WO | WO 2008053273 | A1 * | 5/2008 | ..... B32B 15/012 |
| WO | WO 2009/119751 | A1 | 10/2009 | |
| WO | WO 2010/005121 | A1 | 1/2010 | |
| WO | WO 2011/158818 | A1 | 12/2011 | |
| WO | WO 2012/053636 | A1 | 4/2012 | |

OTHER PUBLICATIONS

Extended European Search Report dated Aug. 5, 2016, in European Patent Application No. 11834475.3.

International Search Report dated Jan. 17, 2012 issued in corresponding PCT Application No. PCT/JP2011/074297 [With English Translation].

International Search Report dated Jan. 17, 2012 issued in related PCT Application No. PCT/JP2011/074299 [With English Translation].

International Search Report dated Jan. 17, 2012 issued in related PCT Application No. PCT/JP2011/074320 [With English Translation].

Iron and Steel Materials, The Japan Institute of Metals, Maruzen Publishing Co., Ltd. p. 20-21, 1985. [With Partial English Translation].

Non-Final Office Action dated Jul. 14, 2016, in parent U.S. Appl. No. 13/879,061.

Notice of Allowance dated Nov. 3, 2016, in parent U.S. Appl. No. 13/879,061.

Office Action dated Feb. 4, 2014 issued in corresponding Japanese Application No. JP 2012-523142 [with English Translation].

Office Action dated Feb. 11, 2016, in related U.S. Appl. No. 13/879,049.

Office Action dated Jan. 7, 2015, in corresponding Canadian Patent Application No. 2,814,630.

Office Action dated Jan. 7, 2015, in corresponding Canadian Patent Application No. 2,814,646.

Office Action dated Oct. 16, 2014, in corresponding Canadian Patent Application No. 2813915.

Restriction Requirement dated Feb. 2, 2016, in parent U.S. Appl. No. 13/879,061.

Search Report dated Feb. 8, 2014 issued in Chinese Application No. CN 201180050249.8 [with English Translation].

Search Report dated Jan. 24, 2014 issued in Chinese Application No. CN 201180050250.0 [with English Translation].

Shigeo Owaku, Yakiiresei (Hardening of steels)—Motomekata to katsuyou (How to obtain and its use)—, publisher Nikkan Kogyo Shimbun, p. 30-47, 1975. [With Partial English Translation].

* cited by examiner

METHOD FOR MANUFACTURING HOT STAMPED BODY AND HOT STAMPED BODY

CROSS-REFERENCE TO RELATED APPLICATIONS

This application is a 37 C.F.R. §1.53(b) divisional of U.S. application Ser. No. 13/879,061 filed Jul. 23, 2013, which is the national phase of PCT International Application No. PCT/JP2011/074297 filed Oct. 21, 2011, which claims priority on Japanese Patent Application Nos. 2010-237249 filed Oct. 22, 2010, and 2010-289527 filed Dec. 27, 2010. The entire contents of each of these applications is hereby incorporated by reference.

TECHNICAL FIELD

The present invention relates to a hot stamped body having a non-heated portion with small variation in hardness, and a method for manufacturing the hot stamped body.

Priority is claimed on Japanese Patent Application No. 2010-237249, filed Oct. 22, 2010, and Japanese Patent Application No. 2010-289527, filed Dec. 27, 2010, the contents of which are incorporated herein by reference.

BACKGROUND ART

In order to obtain high-strength components of a grade of 1180 MPa or higher used for automobile components or the like with excellent dimensional precision, in recent years, a technology (hereinafter, referred to as hot stamping forming) for realizing high strength of a formed product by heating a steel sheet to an austenite range, performing pressing in a softened and high-ductile state, and then rapidly cooling (quenching) in a press die to perform martensitic transformation has been developed.

In general, a steel sheet used for hot stamping contains a lot of C component for securing product strength after hot stamping and contains austenite stabilization elements such as Mn and B for securing hardenability when cooling a die. However, although the strength and the hardenability are properties necessary for a hot stamped product, when manufacturing a steel sheet which is a material thereof, these properties are disadvantageous, in many cases. As a representative disadvantage, with a material having such a high hardenability, a hot-rolled sheet after a hot-rolling step tends to have an uneven microstructure in locations in hot-rolled coil. Accordingly, as means for solving unevenness of the microstructure generated in a hot-rolling step, performing tempering by a batch annealing step after a hot-rolling step or a cold-rolling step may be considered, however, the batch annealing step usually takes 3 or 4 days and thus, is not preferable from a viewpoint of productivity. In recent years, in normal steel other than a material for quenching used for special purposes, from a viewpoint of productivity, it has become general to perform a thermal treatment by a continuous annealing step, other than the batch annealing step.

However, in a case of the continuous annealing step, since the annealing time is short, it is difficult to perform spheroidizing of carbide to realize softness and evenness of a steel sheet by long-time thermal treatment such as a batch treatment. The spheroidizing of the carbide is a treatment for realizing softness and evenness of the steel sheet by holding in the vicinity of an $Ac_1$ transformation point for about several tens of hours. On the other hand, in a case of a short-time thermal treatment such as the continuous annealing step, it is difficult to secure the annealing time necessary for the spheroidizing. That is, in a continuous annealing installation, about 10 minutes is the upper limit as the time for holding at a temperature in the vicinity of the $Ac_1$, due to a restriction of a length of installation. In such a short time, since the carbide is cooled before being subjected to the spheroidizing, the steel sheet has an uneven microstructure in a hardened state. Such partial variation of the microstructure becomes a reason for variation in hardness of a hot stamping material.

Currently, in a widely-used hot stamping formation, it is general to perform quenching at the same time as press working after heating a steel sheet which is a material by furnace heating, and by heating in a heating furnace evenly to an austenitic single phase temperature, it is possible to solve the variation in strength of the material described above. However, a heating method of a hot stamping material by the furnace heating has poor productivity since the heating takes a long time. Accordingly, a technology of improving productivity of the hot stamping material by a short-time heating method by an electrical-heating method is disclosed. By using the electrical-heating method, it is possible to control temperature distribution of a sheet material in a conductive state, by modifying current density flowing to the same sheet material (for example, Patent Document 1).

If the temperature variation exists in the steel sheet for hot stamping by partially heating the steel sheet, the microstructure of the steel sheet does not significantly change from the microstructure of the base material at a non-heated portion. Accordingly, the hardness of the base material before heating becomes directly the hardness of the component. However, as mentioned above, the material which is subject to the cold-rolling after hot-rolling and the continuous annealing has a variation in the strength as shown in FIG. 1, and thus, the non-heated portion has a large variation in the hardness. Accordingly, there is a problem in that a formed component has a variation in the collision performance and the like and thus it is difficult to manage the precision of the quality of the component.

In addition, in order to solve the variation in the hardness, when heating at a temperature equal to or higher than $Ac_3$ so as to be an austenite single phase in an annealing step, a hardened phase such as martensite or bainite is generated in an end stage of the annealing step due to high hardenability by the effect of Mn or B described above, and the hardness of a material significantly increases. As the hot stamping material, this not only becomes a reason for die abrasion in a blank before stamping, but also significantly decreases formability or shape fixability of the non-heated portion. Accordingly, if considering not only a desired hardness after hot stamping quenching, formability or shape fixability of the non-heated portion, a preferable material before hot stamping is a material which is soft and has small variation in hardness, and a material having an amount of C and hardenability to obtain desired hardness after hot stamping quenching. However, if considering manufacturing cost as a priority and assuming the manufacture of the steel sheet in a continuous annealing installation, it is difficult to perform the control described above by an annealing technology of the related art.

Accordingly, if a formed body is obtained by hot stamping a steel sheet which is heated so as to make a heated portion and a non-heated portion exist in the steel sheet, there is a problem in that the formed body one-by-one includes a variation in hardness at the non-heated portion.

CITATION LIST

Patent Document

[Patent Document 1] Japanese Unexamined Patent Application, First Publication No. 2009-274122

Non-Patent Documents

[Non-Patent Document 1] "Iron and Steel Materials", The Japan Institute of Metals, Maruzen Publishing Co., Ltd. p. 21

[Non-Patent Document 2] Steel Standardization Group, "A Review of the Steel Standardization Group's Method for the Determination of Critical Points of Steel," Metal Progress, Vol. 49, 1946, p. 1169

[Non-Patent Document 3] "Yakiiresei (Hardening of steels)—Motomekata to katsuyou (How to obtain and its use)—," (author: OWAKU Shigeo, publisher: Nikkan Kogyo Shimbun

SUMMARY OF INVENTION

Technical Problem

An object of the present invention is to solve the aforementioned problems and to provide a method for manufacturing a hot stamped body which can suppress a variation in hardness at a non-hardened portion even if a steel sheet, which is heated so as to make a heated portion and a non-heated portion exist therein, is hot stamped, and a hot stamped body which has a small variation in hardness at the non-hardened portion.

Solution to Problem

An outline of the present invention made for solving the aforementioned problems is as follows.

(1) According to a first aspect of the present invention, there is provided a method for manufacturing a hot stamped body including the steps of: hot-rolling a slab containing chemical components which include, by mass %, 0.18% to 0.35% of C, 1.0% to 3.0% of Mn, 0.01% to 1.0% of Si, 0.001% to 0.02% of P, 0.0005% to 0.01% of S, 0.001% to 0.01% of N, 0.01% to 1.0% of Al, 0.005% to 0.2% of Ti, 0.0002% to 0.005% of B, and 0.002% to 2.0% of Cr, and the balance of Fe and inevitable impurities, to obtain a hot-rolled steel sheet; coiling the hot-rolled steel sheet which is subjected to hot-rolling; cold-rolling the coiled hot-rolled steel sheet to obtain a cold-rolled steel sheet; continuously annealing the cold-rolled steel sheet which is subjected to cold-rolling to obtain a steel sheet for hot stamping; and performing hot stamping by heating the steel sheet for hot stamping which is continuously annealed so that a heated portion at which a highest heating temperature is equal to or higher than $Ac_3$° C., and a non-heated portion at which a highest heating temperature is equal to or lower than $Ac_1$° C. co-exist, wherein the continuous annealing includes: heating the cold-rolled steel sheet to a temperature range of equal to or higher than $Ac_1$° C. and lower than $Ac_3$° C.; cooling the heated cold-rolled steel sheet from the highest heating temperature to 660° C. at a cooling rate of equal to or less than 10° C./s; and holding the cooled cold-rolled steel sheet in a temperature range of 550° C. to 660° C. for one minute to 10 minutes.

(2) In the method for manufacturing a hot stamped body according to (1), the chemical components may further include one or more from 0.002% to 2.0% of Mo, 0.002% to 2.0% of Nb, 0.002% to 2.0% of V, 0.002% to 2.0% of Ni, 0.002% to 2.0% of Cu, 0.002% to 2.0% of Sn, 0.0005% to 0.0050% of Ca, 0.0005% to 0.0050% of Mg, and 0.0005% to 0.0050% of REM.

(3) In the method for manufacturing a hot stamped body according to (1), any one of a hot-dip galvanizing process, a galvannealing process, a molten aluminum plating process, an alloyed molten aluminum plating process, and an electroplating process, may be performed after the continuous annealing step.

(4) In the method for manufacturing a hot stamped body according to (2), any one of a hot-dip galvanizing process, a galvannealing process, a molten aluminum plating process, an alloyed molten aluminum plating process, and an electroplating process, may be performed after the continuous annealing step.

(5) According to a second aspect of the present invention, there is provided a method for manufacturing a hot stamped body including the steps of: hot-rolling a slab containing chemical components which include, by mass %, 0.18% to 0.35% of C, 1.0% to 3.0% of Mn, 0.01% to 1.0% of Si, 0.001% to 0.02% of P, 0.0005% to 0.01% of S, 0.001% to 0.01% of N, 0.01% to 1.0% of Al, 0.005% to 0.2% of Ti, 0.0002% to 0.005% of B, and 0.002% to 2.0% of Cr, and the balance of Fe and inevitable impurities, to obtain a hot-rolled steel sheet; coiling the hot-rolled steel sheet which is subjected to hot-rolling; cold-rolling the coiled hot-rolled steel sheet to obtain a cold-rolled steel sheet; continuously annealing the cold-rolled steel sheet which is subjected to cold-rolling to obtain a steel sheet for hot stamping; and performing hot stamping by heating the steel sheet for hot stamping which is continuously annealed so that a heated portion at which a highest heating temperature is equal to or higher than $Ac_3$° C., and a non-heated portion at which a highest heating temperature is equal to or lower than Ac1° C. co-exist, wherein, in the hot-rolling, in finish-hot-rolling configured with a machine with 5 or more consecutive rolling stands, rolling is performed by setting a finish-hot-rolling temperature $F_iT$ in a final rolling mill $F_i$ in a temperature range of ($Ac_3$−80)° C. to ($Ac_3$+40)° C., by setting time from start of rolling in a rolling mill $F_{i-3}$ which is a previous machine to the final rolling mill $F_i$ to end of rolling in the final rolling mill $F_i$ to be equal to or longer than 2.5 seconds, and by setting a hot-rolling temperature $F_{i-3}T$ in the rolling mill $F_{i-3}$ to be equal to or lower than $F_iT$+100° C., and after holding in a temperature range of 600° C. to $Ar_3$° C. for 3 seconds to 40 seconds, coiling is performed, the continuous annealing includes: heating the cold-rolled steel sheet to a temperature range of equal to or higher than ($Ac_1$−40)° C. and lower than $Ac_3$° C.; cooling the heated cold-rolled steel sheet from the highest heating temperature to 660° C. at a cooling rate of equal to or less than 10° C./s; and holding the cooled cold-rolled steel sheet in a temperature range of 450° C. to 660° C. for 20 seconds to 10 minutes.

(6) In the method for manufacturing a hot stamped body according to (5), the chemical components may further include one or more from 0.002% to 2.0% of Mo, 0.002% to 2.0% of Nb, 0.002% to 2.0% of V, 0.002% to 2.0% of Ni, 0.002% to 2.0% of Cu, 0.002% to 2.0% of Sn, 0.0005% to 0.0050% of Ca, 0.0005% to 0.0050% of Mg, and 0.0005% to 0.0050% of REM.

(7) In the method for manufacturing a hot stamped body according to (5), any one of a hot-dip galvanizing process, a galvannealing process, a molten aluminum plating process, an alloyed molten aluminum plating process, and an electroplating process, may be performed after the continuous annealing step.

(8) In the method for manufacturing a hot stamped body according to (6), any one of a hot-dip galvanizing process, a galvannealing process, a molten aluminum plating process, an alloyed molten aluminum plating process, and an electroplating process, may be performed after the continuous annealing step.

(9) According to a third aspect of the present invention, there is provided a hot stamped body which is formed using the method for manufacturing a hot stamped body according to any one of (1) to (8), wherein, when the amount of C in the steel sheet is equal to or more than 0.18% and less than 0.25%, ΔHv is equal to or less than 25 and Hv_Ave is equal to or less than 200; when the amount of C in the steel sheet is equal to or more than 0.25% and less than 0.30%, ΔHv is equal to or less than 32 and Hv_Ave is equal to or less than 220; and when the amount of C in the steel sheet is equal to or more than 0.30% and less than 0.35%, ΔHv is equal to or less than 38 and Hv_Ave is equal to or less than 240, where ΔHv represents a variation in Vickers hardness of the non-heated portion, and Hv_Ave represents an average Vickers hardness of the non-heated portion.

Advantageous Effects of Invention

According to the methods according to (1) to (8) described above, since the steel sheet in which physical properties after the annealing are even and soft is used, even when hot stamping a steel sheet which is heated so that a heated portion and non-heated portion co-exist in the steel sheet, it is possible to stabilize the hardness of the non-heated portion of the hot stamped product.

In addition, by performing a hot-dip galvanizing process, a galvannealing process, a molten aluminum plating process, an alloyed molten aluminum plating process, or an electroplating process, after the continuous annealing step, it is advantageous since it is possible to prevent scale generation on a surface, raising a temperature in a non-oxidation atmosphere for avoiding scale generation when raising a temperature of hot stamping is unnecessary, or a descaling process after the hot stamping is unnecessary, and also, rust prevention of the hot stamped product is exhibited.

In addition, by employing such methods, it is possible to obtain a hot stamped body in which, when the amount of C in the steel sheet is equal to or more than 0.18% and less than 0.25%, ΔHv is equal to or less than 25 and Hv_Ave is equal to or less than 200, when the amount of C in the steel sheet is equal to or more than 0.25% and less than 0.30%, ΔHv is equal to or less than 32 and Hv_Ave is equal to or less than 220, and when the amount of C in the steel sheet is equal to or more than 0.30% and less than 0.35%, ΔHv is equal to or less than 38 and Hv_Ave is equal to or less than 240, where ΔHv represents a variation in Vickers hardness of the non-heated portion, and Hv_Ave represents an average Vickers hardness of the non-heated portion.

DESCRIPTION OF EMBODIMENTS

Figure 1:
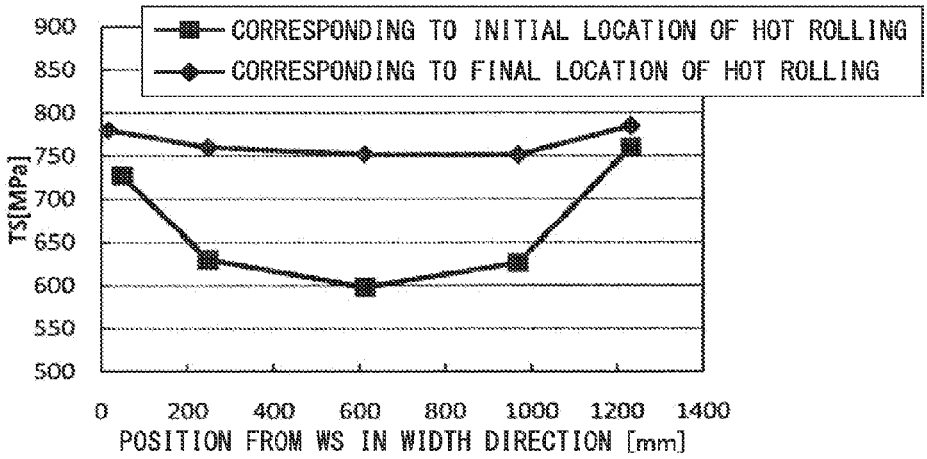
FIG. 1 is a view showing variation in hardness of a steel sheet for hot stamping after continuous annealing of the related art.

Hereinafter, preferred embodiments of the present invention will be described.

First, a method for calculating $Ac_3$ which is important in the present invention will be described. In the present invention, since it is important to obtain an accurate value of $Ac_3$, it is desired to experimentally measure the value, other than calculating from a calculation equation. In addition, it is also possible to measure $Ac_1$ from the same test. As an example of a measurement method, as disclosed in Non-Patent Documents 1 and 2, a method of acquiring from length change of a steel sheet when heating and cooling is general. At the time of heating, a temperature at which austenite starts to appear is $Ac_1$, and a temperature at which austenite single phase appears is $Ac_3$, and it is possible to read each temperature from change in expansion. In a case of experimentally measuring, it is general to use a method of heating a steel sheet after cold-rolling at a heating rate when actually heating in a continuous annealing step, and measuring $Ac_3$ from an expansion curve. The heating rate herein is an average heating rate in a temperature range of "500° C. to 650° C." which is a temperature equal to or lower than $Ac_1$, and heating is performed at a constant rate using the heating rate.

In the present invention, a measured result when setting a rising temperature rate as 5° C./s is used.

Meanwhile, a temperature at which transformation from an austenite single phase to a low temperature transformation phase such as ferrite or bainite starts, is called $Ar_3$, however, regarding transformation in a hot-rolling step, $Ar_3$ changes according to hot-rolling conditions or a cooling rate after rolling. Accordingly, $Ar_3$ was calculated with a calculation model disclosed in ISIJ International, Vol. 32 (1992), No. 3, and a holding time from $Ar_3$ to 600° C. was determined by correlation with an actual temperature.

Hereinafter, a steel sheet for hot stamping according to the present invention used in a method for manufacturing a hot stamped body will be described.

(Quenching Index of Steel Sheet for Hot Stamping)

Since it is aimed for a hot stamping material to obtain high hardness after quenching, the hot stamping material is generally designed to have a high carbon component and a component having high hardenability. Herein, the "high hardenability" means that a $DI_{inch}$ value which is a quenching index is equal to or more than 3. It is possible to calculate the $DI_{inch}$ value based on ASTM A255-67. A detailed calculation method is shown in Non-Patent Document 3. Several calculation methods of the $DI_{inch}$ value have been proposed, regarding an equation of fB for calculating using an additive method and calculating an effect of B, it is possible to use an equation of fB=1+2.7 (0.85—wt % C) disclosed in Non-Patent Document 3. In addition, it is necessary to designate austenite grain size No. according to an added amount of C, however, in practice, since the austenite grain size No. changes depending on hot-rolling conditions, the calculation may be performed by standardizing as a grain size of No. 6.

The $DI_{inch}$ value is an index showing hardenability, and is not always connected to hardness of a steel sheet. That is, hardness of martensite is determined by amounts of C and other solid-solution elements. Accordingly, the problems of this specification do not occur in all steel materials having a large added amount of C. Even in a case where a large amount of C is included, phase transformation of a steel sheet proceeds relatively fastly as long as the $DI_{inch}$ value is a low value, and thus, phase transformation is almost completed before coiling in ROT cooling. Further, also in an annealing step, since ferrite transformation easily proceeds in cooling from a highest heating temperature, it is easy to manufacture a soft hot stamping material. Meanwhile, the problems of this specification are clearly shown in a steel material having a high $DI_{inch}$ value and a large added amount of C. Accordingly, significant effects of the present invention are obtained in a case where a steel material contains 0.18% to 0.35% of C and the $DI_{inch}$ value is equal to or more than 3. Meanwhile, when the $DI_{inch}$ value is extremely high, since the ferrite transformation in the continuous annealing does not proceed, a value of about 10 is preferable as an upper limit of the $DI_{inch}$ value.

(Chemical Components of Steel Sheet for Hot Stamping)

In the method for manufacturing a hot stamped body according to the present invention, a steel sheet for hot stamping manufactured from a steel piece including chemical components which include C, Mn, Si, P, S, N, Al, Ti, B, and Cr and the balance of Fe and inevitable impurities is used. In addition, as optional elements, one or more elements from Mo, Nb, V, Ni, Cu, Sn, Ca, Mg, and REM may be contained. Hereinafter, a preferred range of content of each element will be described. % which indicates content means mass %. In the steel sheet for hot stamping, inevitable impurities other than the elements described above may be contained as long as the content thereof is a degree not significantly disturbing the effects of the present invention, however, as small an amount as possible thereof is preferable.

(C: 0.18% to 0.35%)

When content of C is less than 0.18%, hardened strength after hot stamping becomes low, and rise of hardness in a component becomes small. Meanwhile, when the content of C exceeds 0.35%, formability of the non-heated portion which is heated to $Ac_1$ point or lower is significantly decreased.

Accordingly, a lower limit value of C is 0.18, preferably 0.20% and more preferably 0.22%. An upper limit value of C is 0.35%, preferably 0.33%, and more preferably 0.30%.

(Mn: 1.0% to 3.0%)

When content of Mn is less than 1.0%, it is difficult to secure hardenability at the time of hot stamping. Meanwhile, when the content of Mn exceeds 3.0%, segregation of Mn easily occurs and cracking easily occurs at the time of hot-rolling.

Accordingly, a lower limit value of Mn is 1.0%, preferably 1.2%, and more preferably 1.5%. An upper limit value of Mn is 3.0%, preferably 2.8%, and more preferably 2.5%.

(Si: 0.01% to 1.0%)

Si has an effect of slightly improve the hardenability, however, the effect is slight. By Si having a large solid-solution hardening amount compared to other elements being contained, it is possible to reduce the amount of C for obtaining desired hardness after quenching. Accordingly, it is possible to contribute to improvement of weldability which is a disadvantage of steel having a large amount of C. Accordingly, the effect thereof is large when the added amount is large, however, when the added amount thereof exceeds 1.0%, due to generation of oxides on the surface of the steel sheet, chemical conversion coating for imparting corrosion resistance is significantly degraded, or wettability of galvanization is disturbed. In addition, a lower limit thereof is not particularly provided, however, about 0.01% which is an amount of Si used in a level of normal deoxidation is a practical lower limit.

Accordingly, the lower limit value of Si is 0.01%. The upper limit value of Si is 1.0%, and preferably 0.8%.

(P: 0.001% to 0.02%)

P is an element having a high sold-solution hardening property, however, when the content thereof exceeds 0.02%, the chemical conversion coating is degraded in the same manner as in a case of Si. In addition, a lower limit thereof is not particularly provided, however, it is difficult to have the content of less than 0.001% since the cost significantly rises.

(S: 0.0005% to 0.01%)

Since S generates inclusions such as MnS which degrades toughness or workability, the added amount thereof is desired to be small. Accordingly, the amount thereof is preferably equal to or less than 0.01%. In addition, a lower limit thereof is not particularly provided, however, it is difficult to have the content of less than 0.0005% since the cost significantly rises.

(N: 0.001% to 0.01%)

Since N degrades the effect of improving hardenability when performing B addition, it is preferable to have an extremely small added amount. From this viewpoint, the upper limit thereof is set as 0.01%. In addition, the lower limit is not particularly provided, however, it is difficult to have the content of less than 0.001% since the cost significantly rises.

(Al: 0.01% to 1.0%)

Since Al has the solid-solution hardening property in the same manner as Si, it may be added to reduce the added amount of C. Since Al degrades the chemical conversion coating or the wettability of galvanization in the same manner as Si, the upper limit thereof is 1.0%, and the lower limit is not particularly provided, however, 0.01% which is the amount of Al mixed in at the deoxidation level is a practical lower limit.

(Ti: 0.005% to 0.2%)

Ti is advantageous for detoxicating of N which degrades the effect of B addition. That is, when the content of N is large, B is bound with N, and BN is formed. Since the effect of improving hardenability of B is exhibited at the time of a solid-solution state of B, although B is added in a state of large amount of N, the effect of improving the hardenability is not obtained. Accordingly, by adding Ti, it is possible to fix N as TiN and for B to remain in a solid-solution state. In general, the amount of Ti necessary for obtaining this effect can be obtained by adding the amount which is approximately four times the amount of N from a ratio of atomic weights. Accordingly, when considering the content of N inevitably mixed in, a content equal to or more than 0.005% which is the lower limit is necessary. In addition, Ti is bound with C, and TiC is formed. Since an effect of improving a delayed fracture property after hot stamping can be obtained, when actively improving the delayed fracture property, it is preferable to add equal to or more than 0.05% of Ti. However, if an added amount exceeds 0.2%, coarse TiC is formed in an austenite grain boundary or the like, and cracks are generated in hot-rolling, such that 0.2% is set as the upper limit.

(B: 0.0002% to 0.005%)

B is one of most efficient elements as an element for improving hardenability with low cost. As described above, when adding B, since it is necessary to be in a solid-solution state, it is necessary to add Ti, if necessary. In addition, since the effect thereof is not obtained when the amount thereof is less than 0.0002%, 0.0002% is set as the lower limit. Meanwhile, since the effect thereof becomes saturated when the amount thereof exceeds 0.005%, it is preferable to set 0.005% as the upper limit.

(Cr: 0.002% to 2.0%)

Cr improves hardenability and toughness with a content of equal to or more than 0.002%. The improvement of toughness is obtained by an effect of improving the delayed fracture property by forming alloy carbide or an effect of grain refining of the austenite grain size. Meanwhile, when the content of Cr exceeds 2.0%, the effects thereof become saturated.

(Mo: 0.002% to 2.0%)

(Nb: 0.002% to 2.0%)

(V: 0.002% to 2.0%)

Mo, Nb, and V improve hardenability and toughness with a content of equal to or more than 0.002%, respectively. The effect of improving toughness can be obtained by the improvement of the delayed fracture property by formation of alloy carbide, or by grain refining of the austenite grain size. Meanwhile, when the content of each element exceeds 2.0%, the effects thereof become saturated. Accordingly, the contained amounts of Mo, Nb, and V may be in a range of 0.002% to 2.0%, respectively.

(Ni: 0.002% to 2.0%)

(Cu: 0.002% to 2.0%)

(Sn: 0.002% to 2.0%)

In addition, Ni, Cu, and Sn improve toughness with a content of equal to or more than 0.002%, respectively. Meanwhile, when the content of each element exceeds 2.0%, the effects thereof become saturated. Accordingly, the contained amounts of Ni, Cu, and Sn may be in a range of 0.002% to 2.0%, respectively.

(Ca: 0.0005% to 0.0050%)

(Mg: 0.0005% to 0.0050%)

(REM: 0.0005% to 0.0050%)

Ca, Mg, and REM have effects of grain refining of inclusions with each content of equal to or more than 0.0005% and suppressing thereof. Meanwhile, when the amount of each element exceeds 0.0050%, the effects thereof become saturated. Accordingly, the contained amounts of Ca, Mg, and REM may be in a range of 0.0005% to 0.0050%, respectively.

(Microstructure of Steel Sheet for Hot Stamping)

Next, a microstructure of the steel sheet for hot stamping will be described.

Figure 2:
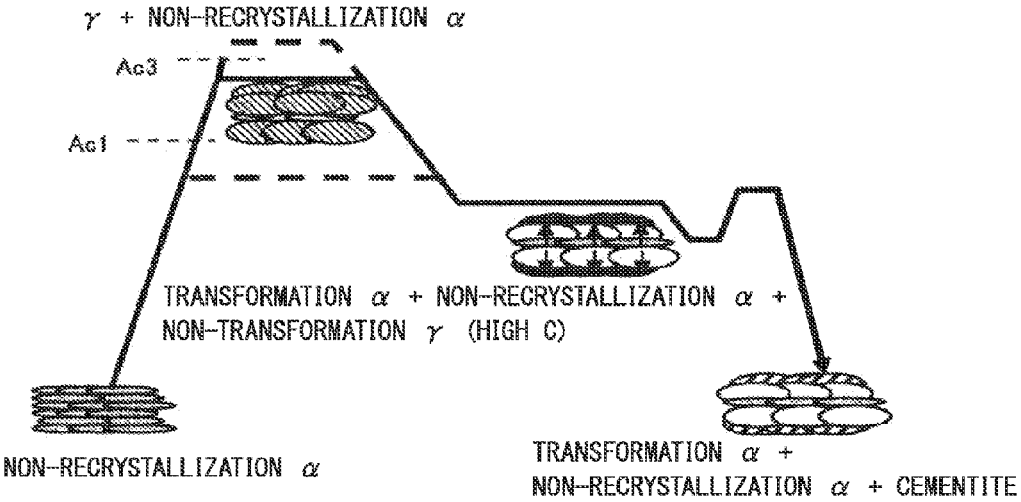
FIG. 2 is a view showing a temperature history model in a continuous annealing step of the present invention.

FIG. 2 shows a temperature history model in the continuous annealing step. In FIG. 2, $Ac_1$ means a temperature at which reverse transformation to austenite starts to occur at the time of temperature rising, and $Ac_3$ means a temperature at which a metal composition of the steel sheet completely becomes austenite at the time of temperature rising. The steel sheet subjected to the cold-rolling step is in a state where the microstructure of the hot-rolled sheet is crushed by cold-rolling, and in this state, the steel sheet is in a hardened state with extremely high dislocation density. In general, the microstructure of the hot-rolled steel sheet of the quenching material is a mixed structure of ferrite and pearlite. However, the microstructure can be controlled to a structure mainly formed of bainite or mainly formed of martensite, by a coiling temperature of the hot-rolled sheet. As will be described later, when manufacturing the steel sheet for hot stamping, by heating the steel sheet to be equal to or higher than $Ac_1$° C. in a heating step, a volume fraction of non-recrystallized ferrite is set to be equal to or less than 30%. In addition, by setting the highest heating temperature to be less than $Ac_3$° C. in the heating step and by cooling from the highest heating temperature to 660° C. at a cooling rate of equal to or less than 10° C./s in the cooling step, ferrite transformation proceeds in cooling, and the steel sheet is softened. When, in the cooling step, the ferrite transformation is promoted and the steel sheet is softened, it is preferable for the ferrite to remain slightly in the heating step, and accordingly, it is preferable to set the highest heating temperature to be "($Ac_1$+20)° C. to ($Ac_3$−10)° C. By heating to this temperature range, in addition to that the hardened non-recrystallized ferrite is softened by recovery and recrystallization due to dislocation movement in annealing, it is possible to austenitize the remaining hardened non-recrystallized ferrite. In the heating step, non-recrystallized ferrite remains slightly, in a subsequent cooling step at a cooling rate of equal to or less than 10° C./s and a holding step of holding in a temperature range of "550° C. to 660° C." for 1 minute to 10 minutes, the ferrite grows by nucleating the non-recrystallized ferrite, and cementite precipitation is promoted by concentration of C in the non-transformed austenite. Accordingly, the main microstructure after the annealing step of the steel sheet for hot stamping according to the embodiment is configured of ferrite, cementite, and pearlite, and contains a part of remaining austenite, martensite, and bainite. The range of the highest heating temperature in the heating step can be expanded by adjusting rolling conditions in the hot-rolling step and cooling conditions in ROT. That is, the factor of the problems originate in variation of the microstructure of the hot-rolled sheet, and if the microstructure of the hot-rolled sheet is adjusted so that the hot-rolled sheet is homogenized and recrystallization of the ferrite after the cold-rolling proceeds evenly and rapidly, although the lower limit of the highest heating temperature in the heating step is expanded to ($Ac_1$−40)° C., it is possible to suppress remaining of the non-recrystallized ferrite and to expand the conditions in the holding step (as will be described later, in a temperature range of "450° C. to 660° C." for 20 seconds to 10 minutes).

In more detail, the steel sheet for hot stamping includes a metal structure in which a volume fraction of the ferrite obtained by combining the recrystallized ferrite and transformed ferrite is equal to or more than 50%, and a volume fraction of the non-recrystallized ferrite fraction is equal to or less than 30%. When the ferrite fraction is less than 50%, the strength of the steel sheet after the continuous annealing step becomes hard. In addition, when the fraction of the non-recrystallized ferrite exceeds 30%, the hardness of the steel sheet after the continuous annealing step becomes hard.

The ratio of the non-recrystallized ferrite can be measured by analyzing an Electron Back Scattering diffraction Pattern (EBSP). The discrimination of the non-recrystallized ferrite and other ferrite, that is, the recrystallized ferrite and the transformed ferrite can be performed by analyzing crystal orientation measurement data of the EBSP by Kernel Average Misorientation method (KAM method). The dislocation is recovered in the grains of the non-recrystallized ferrite, however, continuous change of the crystal orientation generated due to plastic deformation at the time of cold-rolling exists. Meanwhile, the change of the crystal orientation in the ferrite grains except for the non-recrystallized ferrite is extremely small. This is because, while the crystal orientation of adjacent crystal grains is largely different due to the recrystallization and the transformation, the crystal orientation in one crystal grain is not changed. In the KAM method, since it is possible to quantitatively show the crystal orientation difference of adjacent pixels (measurement points), in the present invention, when defining the grain boundary between a pixel in which an average crystal orientation difference with the adjacent measurement point is within 1° (degree) and a pixel in which the average crystal orientation difference with the adjacent measurement point is equal to or more than 2° (degrees), the grain having a crystal grain size of equal to or more than 3 μm is defined as the ferrite other than the non-recrystallized ferrite, that is, the recrystallized ferrite and the transformed ferrite.

In addition, in the steel sheet for hot stamping, (A) a value of a ratio $Cr_\theta/Cr_M$ of concentration $Cr_\theta$ of Cr subjected to solid solution in iron carbide and concentration $Cr_M$ of Cr subjected to solid solution in a base material is equal to or less than 2, or (B) a value of a ratio $Mn_\theta/Mn_M$ of concentration $Mn_\theta$ of Mn subjected to solid solution in iron carbide and concentration $Mn_M$ of Mn subjected to solid solution in a base material is equal to or less than 10.

The cementite which is a representative of the iron carbide is dissolved in the austenite at the time of hot stamping heating, and the concentration of C in the austenite is increased. At the time of heating in a hot stamping step, when heating at a low temperature for a short time by rapid heating or the like, dissolution of cementite is not sufficient and hardenability or hardness after quenching is not sufficient. A dissolution rate of the cementite can be improved by reducing a distribution amount of Cr or Mn which is an element easily distributed in cementite, in the cementite. When the value of $Cr_\theta/Cr_M$ exceeds 2 and the value of $Mn_\theta/Mn_M$ exceeds 10, the dissolution of the cementite in the austenite at the time of heating for short time is insufficient. It is preferable that the value of $Cr_\theta/Cr_M$ be equal to or less than 1.5 and the value of $Mn_\theta/Mn_M$ to be equal to or less than 7.

The $Cr_\theta/Cr_M$ and the $Mn_\theta/Mn_M$ can be reduced by the method for manufacturing a steel sheet. As will be described in detail, it is necessary to suppress diffusion of substitutional elements into the iron carbide, and it is necessary to control the diffusion in the hot-rolling step, and the continuous annealing step after the cold-rolling. The substitutional elements such as Cr or Mn are different from interstitial elements such as C or N, and diffuse into the iron carbide by being held at a high temperature of equal to or higher than 600° C. for long time. To avoid this, there are two major methods. One of them is a method of dissolving all austenite by heating the iron carbide generated in the hot-rolling to $Ac_1$ to $Ac_3$ in the continuous annealing and performing slow cooling from the highest heating temperature at a temperature rate equal to or lower than 10° C./s and holding at 550° C. to 660° C. to generate the ferrite transformation and the iron carbide. Since the iron carbide generated in the continuous annealing is generated in a short time, it is difficult for the substitutional elements to diffuse.

In the other one of them, in the cooling step after the hot-rolling step, by completing ferrite and pearlite transformation, it is possible to realize a soft and even state in which a diffusion amount of the substitutional elements in the iron carbide in the pearlite is small. The reason for limiting the hot-rolling conditions will be described later. Accordingly, in the state of the hot-rolled sheet after the hot-rolling, it is possible to set the values of $Cr_\theta/Cr_M$ and $Mn_\theta/Mn_M$ as low values. Thus, in the continuous annealing step after the cold-rolling, even with the annealing in a temperature range of $(Ac_1-40)$° C. at which only recrystallization of the ferrite occurs, if it is possible to complete the transformation in the ROT cooling after the hot-rolling, it is possible to set the $Cr_\theta/Cr_M$ and the $Mn_\theta/Mn_M$ to be low.

Figure 6:
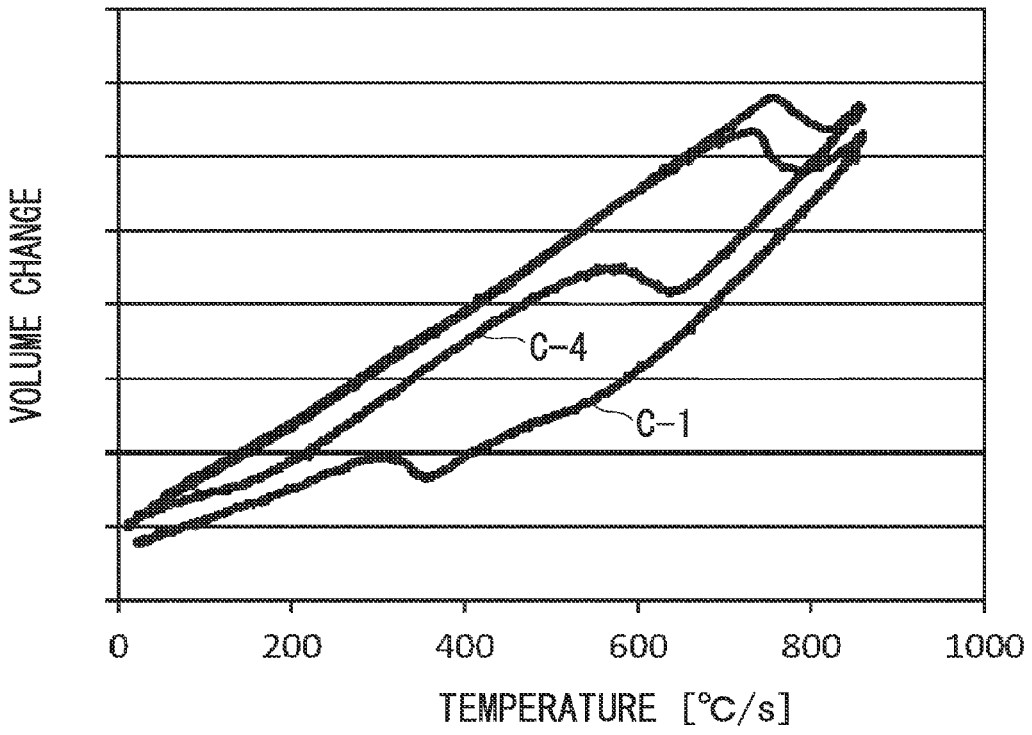
FIG. 6 is a view showing variation in hardenability when hot stamping by values of $Cr_\theta/Cr_M$ and $Mn_\theta/Mn_M$ in the present invention.

As shown in FIG. 6, the threshold values were determined from an expansion curve when holding C-1 in which the values of $Cr_\theta/Cr_M$ and $Mn_\theta/Mn_M$ are low and C-4 in which the values of $Cr_\theta/Cr_M$ and $Mn_\theta/Mn_M$ are high, for 10 seconds after heating to 850° C. at 150° C./s, and then cooling at 5° C./s. That is, while the transformation starts from the vicinity of 650° C. in the cooling, in a material in which the values of $Cr_\theta/Cr_M$ and $Mn_\theta/Mn_M$ are high, clear phase transformation is not observed at a temperature equal to or lower than 400° C., in the material in which the values of $Cr_\theta/Cr_M$ and $Mn_\theta/Mn_M$ are high. That is, by setting the values of $Cr_\theta/Cr_M$ and $Mn_\theta/Mn_M$ to be low, it is possible to improve hardenability after the rapid heating.

A measurement method of component analysis of Cr and Mn in the iron carbide is not particularly limited, however, for example, analysis can be performed with an energy diffusion spectrometer (EDS) attached to a TEM, by manufacturing replica materials extracted from arbitrary locations of the steel sheet and observing using the transmission electron microscope (TEM) with a magnification of 1000 or more. Further, for component analysis of Cr and Mn in a parent phase, the EDS analysis can be performed in ferrite grains sufficiently separated from the iron carbide, by manufacturing a thin film generally used.

In addition, in the steel sheet for hot stamping, a fraction of the non-segmentalized pearlite may be equal to or more than 10%. The non-segmentalized pearlite shows that the pearlite which is austenitized once in the annealing step is transformed to the pearlite again in the cooling step, the non-segmentalized pearlite shows that the values of $Cr_\theta/Cr_M$ and $Mn_\theta/Mn_M$ are lower.

If the fraction of the non-segmentalized pearlite is equal to or more than 10%, the hardenability of the steel sheet is improved.

Figure 7A:
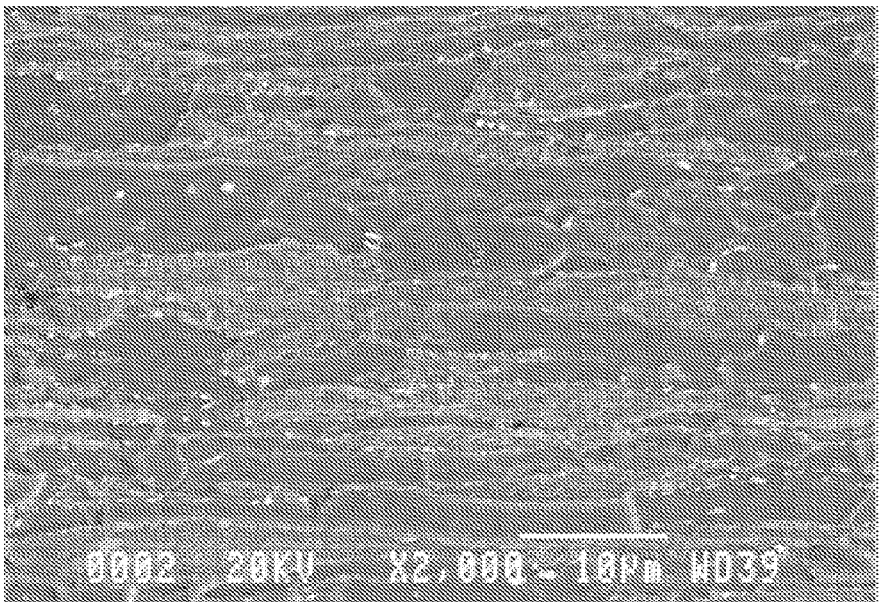
FIG. 7A is a result of segmentalized pearlite observed by a 2000×SEM.
Figure 7B:
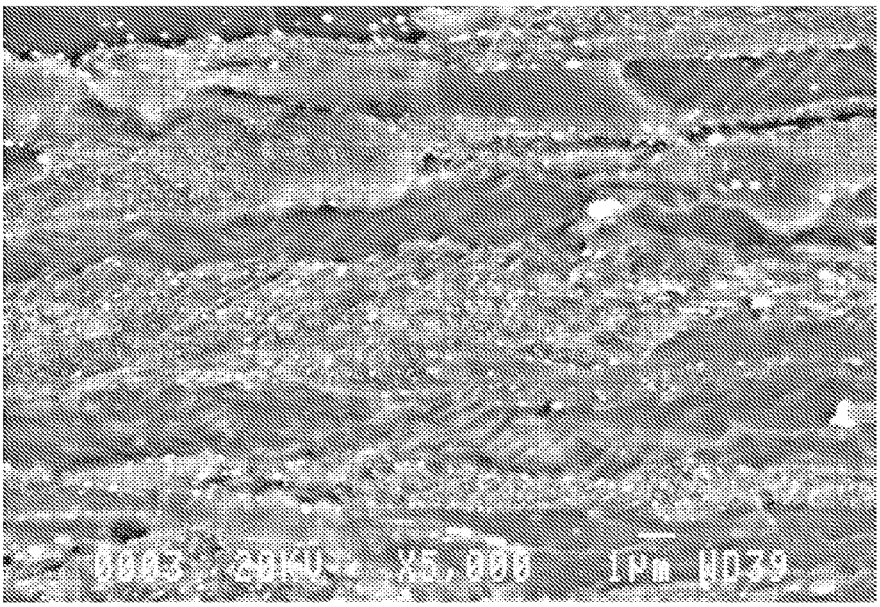
FIG. 7B is a result of segmentalized pearlite observed by a 5000×SEM.
Figure 8A:
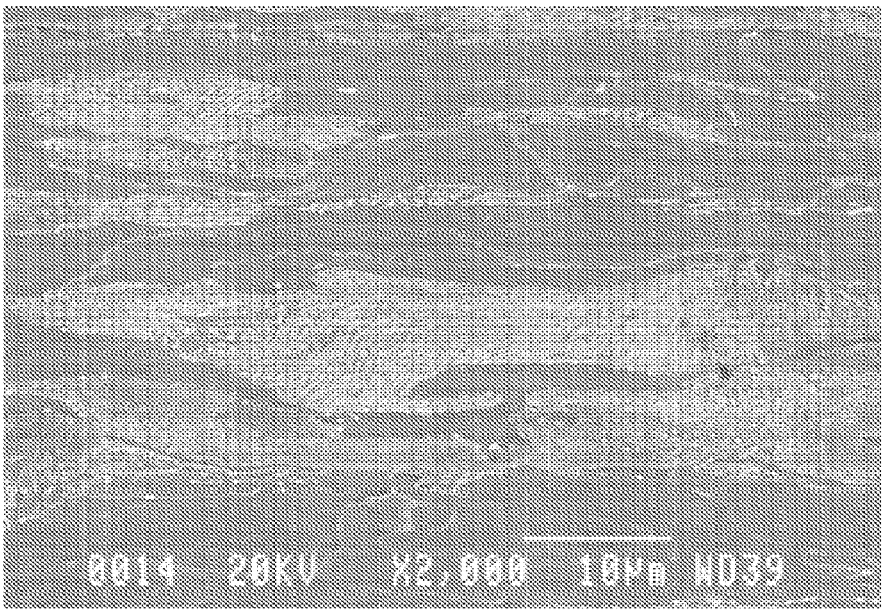
FIG. 8A is a result of non-segmentalized pearlite observed by a 2000×SEM.
Figure 8B:
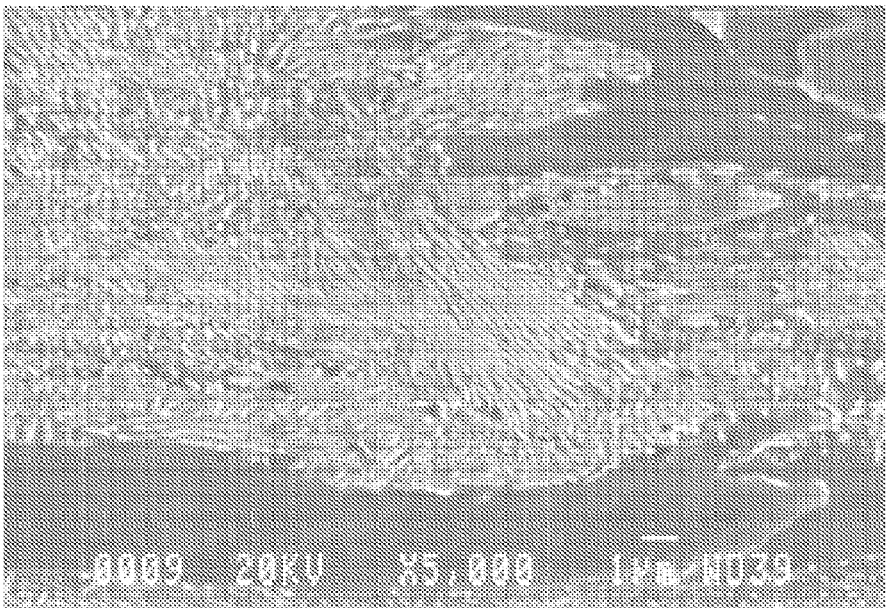
FIG. 8B is a result of non-segmentalized pearlite observed by a 5000×SEM.

When the microstructure of the hot-rolled steel sheet is formed from the ferrite and the pearlite, if the ferrite is recrystallized after cold-rolling the hot-rolled steel sheet to about 50%, generally, the location indicating the non-segmentalized pearlite is in a state where the pearlite is finely segmentalized, as shown in the result observed by the SEM of FIGS. 7A and 7B. On the other hand, when heating in the continuous annealing to be equal to or higher than $Ac_1$, after the pearlite is austenitized once, by the subsequent cooling step and holding, the ferrite transformation and the pearlite transformation occur. Since the pearlite is formed by transformation for a short time, the pearlite is in a state not containing the substitutional elements in the iron carbide and has a shape not segmentalized as shown in FIGS. 8A and 8B.

An area ratio of the non-segmentalized pearlite can be obtained by observing a cut and polished test piece with an optical microscope, and measuring the ratio using a point counting method.

First Embodiment

Hereinafter, a method for manufacturing a hot stamped steel sheet according to a first embodiment of the present invention will be described.

The method for manufacturing a hot stamped steel sheet according to the embodiment includes at least a hot-rolling step, a coiling step, a cold-rolling step, a continuous annealing step, and a hot stamping step. Hereinafter, each step will be described in detail.

(Hot-Rolling Step)

In the hot-rolling step, a steel piece having the chemical components described above is heated (re-heated) to a temperature of equal to or higher than 1100° C., and the hot-rolling is performed. The steel piece may be a slab obtained immediately after being manufactured by a continuous casting installation, or may be manufactured using an electric furnace. By heating the steel piece to a temperature of equal to or higher than 1100° C., carbide-forming elements and carbon can be subjected to decomposition-dissolving sufficiently in the steel material. In addition, by heating the steel piece to a temperature of equal to or higher than 1200° C., precipitated carbonitrides in the steel piece can be sufficiently dissolved. However, it is not preferable to heat the steel piece to a temperature higher than 1280° C., from a view point of production cost.

When a finishing temperature of the hot-rolling is lower than $Ar_3$° C., the ferrite transformation occurs in rolling by contact of the surface layer of the steel sheet and a mill roll, and deformation resistance of the rolling may be significantly high. The upper limit of the finishing temperature is not particularly provided, however, the upper limit may be set to about 1050° C.

(Coiling Step)

It is preferable that a coiling temperature in the coiling step after the hot-rolling step be in a temperature range of "700° C. to 900° C." (ferrite transformation and pearlite transformation range) or in a temperature range of "25° C. to 500° C." (martensite transformation or bainite transformation range). In general, since the coil after the coiling is cooled from the edge portion, the cooling history becomes uneven, and as a result, unevenness of the microstructure easily occurs, however, by coiling the hot-rolled coil in the temperature range described above, it is possible to suppress the unevenness of the microstructure from occurring in the hot-rolling step. However, even with a coiling temperature beyond the preferred range, it is possible to reduce significant variation thereof compared to the related art by control of the microstructure in the continuous annealing.

(Cold-Rolling Step)

In the cold-rolling step, the coiled hot-rolled steel sheet is cold-rolled after pickling, and a cold-rolled steel sheet is manufactured.

(Continuous Annealing Step)

In the continuous annealing step, the cold-rolled steel sheet is subjected to continuous annealing. The continuous annealing step includes a heating step of heating the cold-rolled steel sheet in a temperature range of equal to or higher than "$Ac_1$° C. and lower than $Ac_3$° C.", and a cooling step of subsequently cooling the cold-rolled steel sheet to 660° C. from the highest heating temperature by setting a cooling rate to 10° C./s or less, and a holding step of subsequently holding the cold-rolled steel sheet in a temperature range of "550° C. to 660° C." for 1 minute to 10 minutes.

(Hot Stamping Step)

In the hot stamping step, hot stamping is performed for the steel sheet which is heated so as to have a heated portion and a non-heated portion. The heated portion (hardening portion) is heated to the temperature of $Ac_3$ or higher. General conditions may be employed for the heating rate thereof or the subsequent cooling rate. However, since the production efficiency is extremely low at a heating rate of less than 3° C./s, the heating rate may be set to be equal to or more than 3° C./s. In addition, since the heated portion may not be sufficiently quenched or the heat may transfer to the non-heated portion, in particular, at a cooling rate of less than 3° C./s, the cooling rate may be set to be equal to or more than 3° C./s.

The heating method to make the steel sheet have the heated portion and the non-heated portion is not particularly regulated, and for example, a method of performing electrical-heating, a method of providing a heat-insulating member on the portion that should not be heated, a method of heating a particular portion of the steel sheet by infrared ray radiation, or the like may be employed.

The upper limit of the highest heating temperature may be set to 1000° C. so as to avoid the non-heated portion from being heated due to heat transfer. In addition, the holding at the highest heating temperature may not be performed since it is not necessary to provide a particular holding time as long as reverse transformation to the austenite single phase is obtained.

The heated portion means a portion at which the highest heating temperature at the time of heating the steel sheet in the hot stamping process reaches $Ac_3$ or higher. The non-heated portion means a portion where the highest heating temperature at the time of heating the steel sheet in the hot stamping process is within the temperature range of equal to or less than $Ac_1$. The non-heated portion includes a portion that is not heated, and a portion that is heated to Ac1 or lower.

According to the method for manufacturing a hot stamped body described above, since a steel sheet for hot press in which hardness is even and which is soft is used, even in a case of hot-stamping the steel sheet in a state of including a non-heated portion, it is possible to reduce variation of the hardness of the non-heated portion of the hot stamped body. In detail, it is possible to realize the following ΔHv which represents a variation in Vickers hardness of the non-heated portion, and Hv_Ave which represents an average Vickers hardness of the non-heated portion.

If the amount of C in the steel sheet is equal to or more than 0.18% and less than 0.25%, ΔHv is equal to or less than 25 and Hv_Ave is equal to or less than 200.

If the amount of C in the steel sheet is equal to or more than 0.25% and less than 0.30%, ΔHv is equal to or less than 32 and Hv_Ave is equal to or less than 220.

If the amount of C in the steel sheet is equal to or more than 0.30% and less than 0.35%, ΔHv is equal to or less than 38 and Hv_Ave is equal to or less than 240.

The steel sheet for hot stamping contains a lot of C component for securing quenching strength after the hot stamping and contains Mn and B, and in such a steel component having high hardenability and high concentration of C, the microstructure of the hot-rolled sheet after the hot-rolling step tends to easily become uneven. However, according to the method for manufacturing the cold-rolled steel sheet for hot stamping according to the embodiment, in the continuous annealing step subsequent to the latter stage of the cold-rolling step, the cold-rolled steel sheet is heated in a temperature range of "equal to or higher than $Ac_1$° C. and less than $Ac_3$° C.", then cooled from the highest temperature to 660° C. at a cool rate of equal to or less than 10° C./s, and then held in a temperature range of "550° C. to 660° C." for 1 minute to 10 minutes, and thus the microstructure can be obtained to be even.

In the continuous annealing line, a hot-dip galvanizing process, a galvannealing process, a molten aluminum plating process, an alloyed molten aluminum plating process, and an electroplating process can also be performed. The effects of the present invention are not lost even when the plating process is performed after the annealing step.

As shown in the schematic view of FIG. 2, the microstructure of the steel sheet subjected to the cold-rolling step is a non-recrystallized ferrite. In the method for manufacturing of a steel sheet according to the embodiment, in the continuous annealing step, by heating to a heating range of "equal to or higher than $Ac_1$° C. and lower than $Ac_3$° C." which is a higher temperature range than the $Ac_1$ point, heating is performed until having a double phase coexistence with the austenite phase in which the non-recrystallized ferrite slightly remains. After that, in the cooling step at a cooling rate of equal to or less than 10° C./s, growth of the transformed ferrite which is nucleated from the non-recrystallized ferrite slightly remaining at the highest heating temperature occurs. Then, in the holding step of holding the steel sheet at a temperature range of "550° C. to 660° C." for 1 minute to 10 minutes, incrassating of C into the non-transformed austenite occurs at the same time as ferrite transformation, and cementite precipitation or pearlite transformation is promoted by holding in the same temperature range.

The steel sheet for hot stamping contains a lot of C component for securing quenching hardness after the hot stamping and contains Mn and B, and B has an effect of suppressing generation of the ferrite nucleation at the time of cooling from the austenite single phase, generally, and when cooling is performed after heating to the austenite single phase range of equal to or higher than $Ac_3$, it is difficult for the ferrite transformation to occur. However, by holding the heating temperature in the continuous annealing step in a temperature range of "equal to or higher than $Ac_1$° C. and less than $Ac_3$° C." which is immediately below $Ac_3$, the ferrite slightly remains in a state where almost hardened non-recrystallized ferrite is reverse-transformed to the austenite, and in the subsequent cooling step at a cooling rate of equal to or less than 10° C./s and the holding step of holding at a temperature range of "550° C. to 660° C." for 1 minute to 10 minutes, softening is realized by the growth of the ferrite by nucleating the remaining ferrite. In addition, if the heating temperature in the continuous annealing step is higher than $Ac_3$° C., since the austenite single phase mainly occurs, and then the ferrite transformation in the cooling is insufficient, and the hardening is realized, the temperature described above is set as the upper limit, and if the heating temperature is lower than $Ac_1$, since the volume fraction of the non-recrystallized ferrite becomes high and the hardening is realized, the temperature described above is set as the lower limit.

Further, in the holding step of holding the cold-rolled steel sheet in a temperature range of "550° C. to 660° C." for 1 minute to 10 minutes, the cementite precipitation or the pearlite transformation can be promoted in the non-transformed austenite in which C is incrassated after the ferrite transformation. Thus, according to the method for manufacturing a steel sheet according to the embodiment, even in a case of heating a material having high hardenability to a temperature right below the $Ac_3$ point by the continuous annealing, most parts of the microstructure of the steel sheet can be set as ferrite and cementite. According to the proceeding state of the transformation, the bainite, the martensite, and the remaining austenite slightly exist after the cooling, in some cases.

In addition, if the temperature in the holding step exceeds 660° C., the proceeding of the ferrite transformation is delayed and the annealing takes long time. On the other hand, when the temperature is lower than 550° C., the ferrite itself which is generated by the transformation is hardened, it is difficult for the cementite precipitation or the pearlite transformation to proceed, or the bainite or the martensite which is the lower temperature transformation product occurs. In addition, when the holding time exceeds 10 minutes, the continuous annealing installation subsequently becomes longer and high cost is necessary, and on the other hand, when the holding time is lower than 1 minute, the ferrite transformation, the cementite precipitation, or the pearlite transformation is insufficient, the structure is mainly formed of bainite or martensite in which most parts of the microstructure after the cooling are hardened phase, and the steel sheet is hardened.

According to the manufacturing method described above, by coiling the hot-rolled coil subjected to the hot-rolling step in a temperature range of "700° C. to 900° C." (range of ferrite or pearlite), or by coiling in a temperature range of "25° C. to 550° C." which is a low temperature transformation temperature range, it is possible to suppress the unevenness of the microstructure of the hot-rolled coil after coiling. That is, the vicinity of 600° C. at which the normal steel is generally coiled is a temperature range in which the ferrite transformation and the pearlite transformation occur, however, when coiling the steel type having high hardenability in the same temperature range after setting the conditions of the hot-rolling finishing normally performed, since almost no transformation occurs in a cooling device section which is called Run-Out-Table (hereinafter, ROT) from the finish rolling of the hot-rolling step to the coiling, the phase transformation from the austenite occurs after the coiling. Accordingly, when considering a width direction of the coil, the cooling rates in the edge portion exposed to the external air and the center portion shielded from the external air are different from each other. Further, also in the case of considering a longitudinal direction of the coil, in the same manner as described above, cooling histories in a tip end or a posterior end of the coil which can be in contact with the external air and in an intermediate portion shielded from the external air are different from each other. Accordingly, in the component having high hardenability, when coiling in a temperature range in the same manner as in a case of normal steel, the microstructure or the strength of the hot-rolled sheet significantly varies in one coil due to the difference of the cooling history. When performing annealing by the continuous annealing installation after the cold-rolling using the hot-rolled sheet, in the ferrite recrystallization temperature range of equal to or lower than $Ac_1$, significant variation in the strength is generated as shown in FIG. 1 by the variation in the ferrite recrystallization rate caused by the variation of the microstructure of the hot-rolled sheet. Meanwhile, when heating to the temperature range of equal to or higher than $Ac_1$ and cooling as it is, not only a lot of non-recrystallized ferrite remains, but the austenite which is partially reverse-transformed is transformed to the bainite or the martensite which is a hardened phase, and becomes a hard material having significant variation. When heating to a temperature of equal to or higher than $Ac_3$ to completely remove the non-recrystallized ferrite, significant hardening is performed after the cooling with an effect of elements for improving hardenability such as Mn or B. Accordingly, it is advantageous to perform coiling at the temperature range described above for evenness of the microstructure of the hot-rolled sheet. That is, by performing coiling in the temperature range of "700° C. to 900° C.", since cooling is sufficiently performed from the high temperature state after the coiling, it is possible to form the entire coil with the ferrite/pearlite structure. Meanwhile, by coiling in the temperature range of "25° C. to 550° C.", it is possible to form the entire coil into the bainite or the martensite which is hard.

Figure 3A:
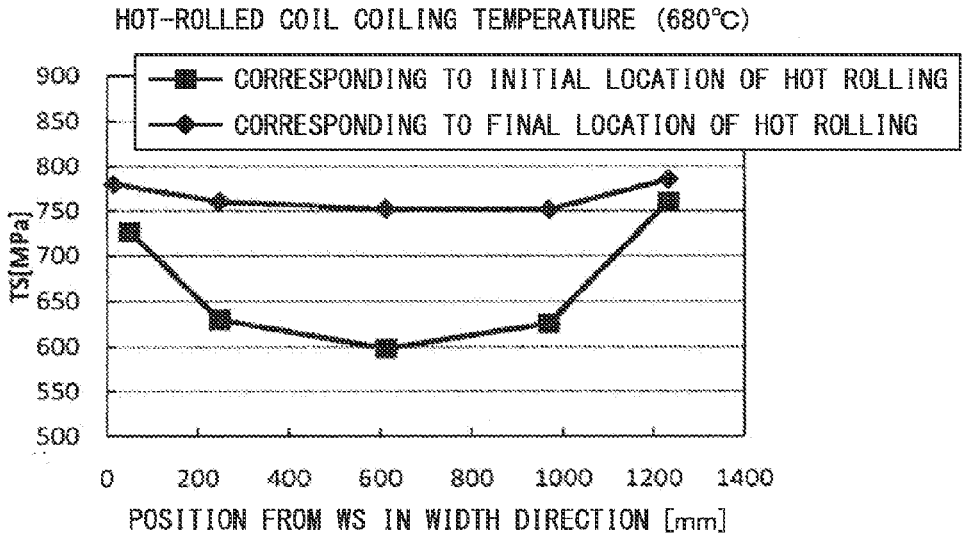
FIG. 3A is a view showing variation in hardness of a steel sheet for hot stamping after continuous annealing in which a coiling temperature is set to 680° C.
Figure 3B:
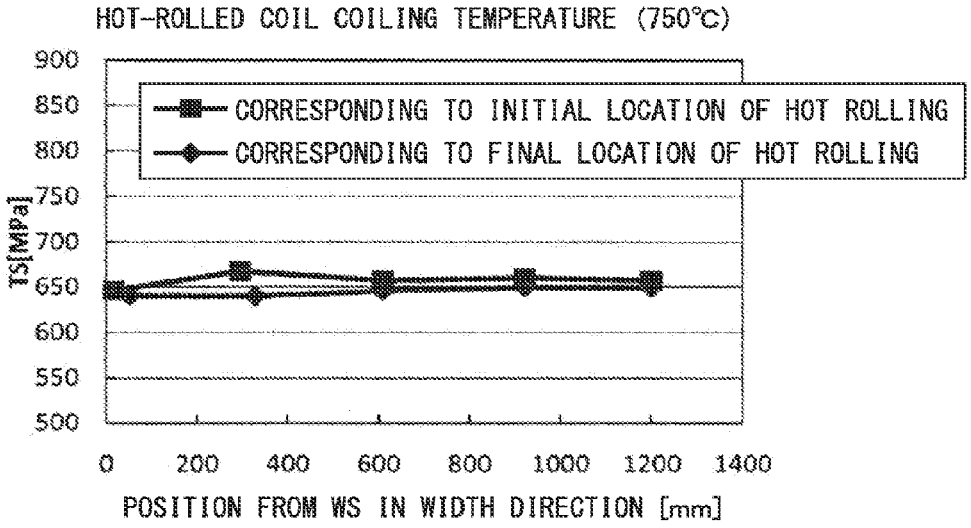
FIG. 3B is a view showing variation in hardness of a steel sheet for hot stamping after continuous annealing in which a coiling temperature is set to 750° C.
Figure 3C:
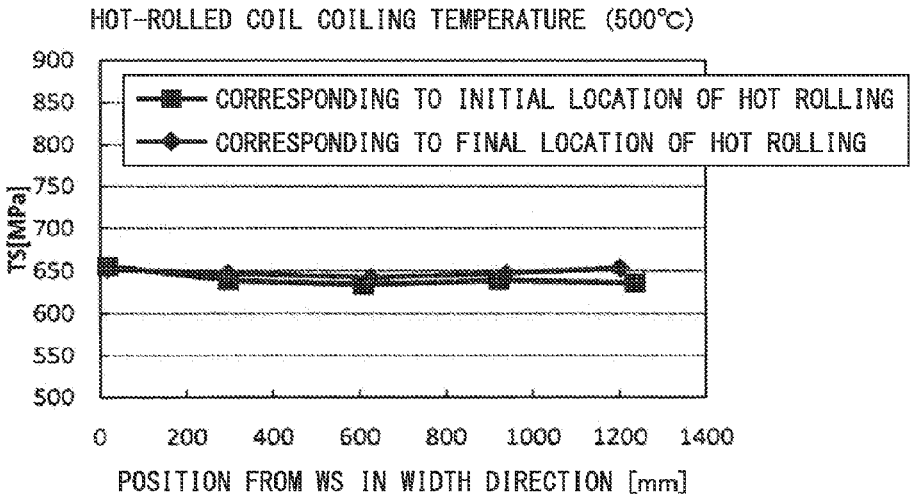
FIG. 3C is a view showing variation in hardness of a steel sheet for hot stamping after continuous annealing in which a coiling temperature is set to 500° C.

FIGS. 3A to 3C show variation in strength of the steel sheet for hot stamping after the continuous annealing with different coiling temperatures for the hot-rolled coil. FIG. 3A shows a case of performing continuous annealing by setting a coiling temperature as 680° C., FIG. 3B shows a case of performing the continuous annealing by setting a coiling temperature at as 750° C., that is, in the temperature range of "700° C. to 900° C." (ferrite transformation and pearlite transformation range), and FIG. 3C shows a case of performing continuous annealing by setting a coiling temperature as 500° C., that is, in the temperature range of "25° C. to 500° C." (bainite transformation and martensite transformation range). In FIGS. 3A to 3C, ΔTS indicates variation of the steel sheet (maximum value of tensile strength of steel sheet−minimum value thereof). As clearly shown in FIGS. 3A to 3C, by performing the continuous annealing with suitable conditions, it is possible to obtain even strength and soft hardness of the steel sheet after the annealing.

By using the steel having the even strength, in the hot stamping step, even in a case of employing an electrical-heating method which inevitably generates an irregularity in the steel sheet temperature after heating, it is possible to stabilize the strength of a component of the formed product after the hot stamping. For example, for an electrode holding portion or the like in which the temperature does not rise by the electrical-heating and in which the strength of the material of the steel sheet itself affects the product strength, by evenly managing the strength of the material of the steel sheet itself, it is possible to improve management of precision of the product quality of the formed product after the hot stamping.

Second Embodiment

Hereinafter, a method for manufacturing a hot stamped steel sheet according to a second embodiment of the present invention will be described.

The method for manufacturing a hot stamped steel sheet according to the embodiment includes at least a hot-rolling step, a coiling step, a cold-rolling step, a continuous annealing step, and a hot stamping step. Hereinafter, each step will be described in detail.

(Hot-Rolling Step)

In the hot-rolling step, a steel piece having the chemical components described above is heated (re-heated) to a temperature of equal to or higher than 1100° C., and the hot-rolling is performed. The steel piece may be a slab obtained immediately after being manufactured by a continuous casting installation, or may be manufactured using an electric furnace. By heating the steel piece to a temperature of equal to or higher than 1100° C., carbide-forming elements and carbon can be subjected to decomposition-dissolving sufficiently in the steel material. In addition, by heating the steel piece to a temperature of equal to or higher than 1200° C., precipitated carbonitrides in the steel piece can be sufficiently dissolved. However, it is not preferable to heat the steel piece to a temperature higher than 1280° C., from a view point of production cost.

In the hot-rolling step of the embodiment, in finish-hot-rolling configured with a machine with 5 or more consecutive rolling stands, rolling is performed by (A) setting a finish-hot-rolling temperature $F_iT$ in a final rolling mill $F_i$ in a temperature range of $(Ac_3-80)$° C. to $(Ac_3+40)$° C., by (B) setting a time from start of rolling in a rolling mill $F_{i-3}$ which is a previous machine to the final rolling mill $F_i$ to end of rolling in the final rolling mill $F_i$ to be equal to or longer than 2.5 seconds, and by (C) setting a hot-rolling temperature $F_{i-3}T$ in the rolling mill $F_{i-3}$ to be equal to or lower than $(F_iT+100)$° C., and then holding is performed in a temperature range of "600° C. to $Ar_3$° C." for 3 seconds to 40 seconds, and coiling is performed in the coiling step.

By performing such hot-rolling, it is possible to perform stabilization and transformation from the austenite to the ferrite, the pearlite, or the bainite which is the low temperature transformation phase in the ROT (Run Out Table) which is a cooling bed in the hot-rolling, and it is possible to reduce the variation in the hardness of the steel sheet accompanied with a cooling temperature deviation generated after the coil coiling. In order to complete the transformation in the ROT, refining of the austenite grain size and holding at a temperature of equal to or lower than $Ar_3$° C. in the ROT for a long time are important conditions.

When the $F_iT$ is less than $(Ac_3-80)$° C., a possibility of the ferrite transformation in the hot-rolling becomes high and hot-rolling deformation resistance is not stabilized. On the other hand, when the $F_iT$ is higher than $(Ac_3+40)$° C., the austenite grain size immediately before the cooling after the finishing hot-rolling becomes coarse, and the ferrite transformation is delayed. It is preferable that $F_iT$ be set as a temperature range of "$(Ac_3-70)$° C. to $(Ac_3+20)$° C.". By setting the heating conditions as described above, it is possible to refine the austenite grain size after the finish rolling, and it is possible to promote the ferrite transformation in the ROT cooling. Accordingly, since the transformation proceeds in the ROT, it is possible to largely reduce the variation of the microstructure in longitudinal and width directions of the coil caused by the variation of coil cooling after the coiling.

For example, in a case of a hot-rolling line including seven final rolling mills, transit time from a $F_4$ rolling mill which corresponds to a third mill from an $F_7$ rolling mill which is a final stand, to the $F_7$ rolling mill is set as 2.5 seconds or longer. When the transit time is less than 2.5 seconds, since the austenite is not recrystallized between stands, B segregated to the austenite grain boundary significantly delays the ferrite transformation and it is difficult for the phase transformation in the ROT to proceed. The transit time is preferably equal to or longer than 4 seconds. It is not particularly limited, however, when the transition time is equal to or longer than 20 seconds, the temperature of the steel sheet between the stands largely decreases and it is impossible to perform hot-rolling.

For recrystallizing so that the austenite is refined and B does not exist in the austenite grain boundary, it is necessary to complete the rolling at an extremely low temperature of equal to or higher than $Ar_3$, and to recrystallize the austenite at the same temperature range. Accordingly, a temperature on the rolling exit side of the $F_4$ rolling mill is set to be equal to or lower than ($F_iT$+100)° C. This is because it is necessary to lower the temperature of the rolling temperature of the $F_4$ rolling mill for obtaining an effect of refining the austenite grain size in the latter stage of the finish rolling. The lower limit of $F_{i-3}T$ is not particularly provided, however, since the temperature on the exit side of the final $F_7$ rolling mill is $F_iT$, this is set as the lower limit thereof.

By setting the holding time in the temperature range of 600° C. to $Ar_3$° C. to be a long time, the ferrite transformation occurs. Since the $Ar_3$ is the ferrite transformation start temperature, this is set as the upper limit, and 600° C. at which the softened ferrite is generated is set as the lower limit. A preferable temperature range thereof is 600° C. to 700° C. in which generally the ferrite transformation proceeds most rapidly.

(Coiling Step)

By holding the coiling temperature in the coiling step after the hot-rolling step at 600° C. to $Ar_3$° C. for 3 seconds or longer in the cooling step, the hot-rolled steel sheet in which the ferrite transformation proceeded, is coiled as it is. Substantially, although it is changed by the installation length of the ROT, the steel sheet is coiled in the temperature range of 500° C. to 650° C. By performing the hot-rolling described above, the microstructure of the hot-rolled sheet after the coil cooling has a structure mainly including the ferrite and the pearlite, and it is possible to suppress the unevenness of the microstructure generated in the hot-rolling step.

(Cold-Rolling Step)

In the cold-rolling step, the coiled hot-rolled steel sheet is cold-rolled after pickling, and a cold-rolled steel sheet is manufactured.

(Continuous Annealing Step)

In the continuous annealing step, the cold-rolled steel sheet is subjected to continuous annealing. The continuous annealing step includes a heating step of heating the cold-rolled steel sheet in a temperature range of equal to or higher than "($Ac_1$−40)° C. and lower than $Ac_3$° C.", and a cooling step of subsequently cooling the cold-rolled steel sheet to 660° C. from the highest heating temperature by setting a cooling rate to 10° C./s or less, and a holding step of subsequently holding the cold-rolled steel sheet in a temperature range of "450° C. to 660° C." for 20 seconds to 10 minutes.

(Hot Stamping Step)

In the hot stamping step, hot stamping is performed for the steel sheet which is heated so as to have a heated portion and a non-heated portion. The heated portion (hardening portion) is heated to the temperature of $Ac_3$ or more. General conditions may be employed for the heating rate thereof or the subsequent cooling rate. However, since the production efficiency is extremely low at a heating rate of less than 3° C./s, the heating rate may be set to be equal to or more than 3° C./s. In addition, since the heated portion may not be sufficiently quenched or the heat may transfer to the non-heated portion, in particular, at a cooling rate of less than 3° C./s, the cooling rate may be set to be equal to or more than 3° C./s.

The heating method to make the steel sheet have the heated portion and the non-heated portion is not particularly regulated, and for example, a method of performing electrical-heating, a method of providing a heat-insulating member on the portion that should not be heated, a method of heating a particular portion of the steel sheet by infrared ray radiation, or the like may be employed.

The upper limit of the highest heating temperature may be set to 1000° C. so as to avoid the non-heated portion from being heated due to heat transfer. In addition, the holding at the highest heating temperature may not be performed since it is not necessary to provide a particular holding time as long as reverse transformation to the austenite single phase is obtained.

The heated portion means a portion at which the highest heating temperature at the time of heating the steel sheet in the hot stamping process reaches $Ac_3$ or higher. The non-heated portion means a portion where the highest heating temperature at the time of heating the steel sheet in the hot stamping process is within the temperature range of equal to or less than $Ac_1$. The non-heated portion includes a portion that is not heated, and a portion that is heated to Ac1 or lower.

According to the method for manufacturing a hot stamped body described above, since a steel sheet for hot press in which hardness is even and which is soft is used, even in a case of hot-stamping the steel sheet in a state of including a non-heated portion, it is possible to reduce variation of the hardness of the non-heated portion of the hot stamped body. In detail, it is possible to realize the following ΔHv which represents a variation in Vickers hardness of the non-heated portion, and Hv_Ave which represents an average Vickers hardness of the non-heated portion.

If the amount of C in the steel sheet is equal to or more than 0.18% and less than 0.25%, ΔHv is equal to or less than 25 and Hv_Ave is equal to or less than 200.

If the amount of C in the steel sheet is equal to or more than 0.25% and less than 0.30%, ΔHv is equal to or less than 32 and Hv_Ave is equal to or less than 220.

If the amount of C in the steel sheet is equal to or more than 0.30% and less than 0.35%, ΔHv is equal to or less than 38 and Hv_Ave is equal to or less than 240.

Since the steel sheet is coiled into a coil after transformation from the austenite to the ferrite or the pearlite in the ROT by the hot-rolling step of the second embodiment described above, the variation in the strength of the steel sheet accompanied with the cooling temperature deviation generated after the coiling is reduced. Accordingly, in the continuous annealing step subsequent to the latter stage of the cold-rolling step, by heating the cold-rolled steel sheet in the temperature range of "equal to or higher than ($Ac_1$−40)° C. to lower than $Ac_3$° C.", subsequently cooling from the highest temperature to 660° C. at a cooling rate of equal to or less than 10° C./s, and subsequently holding in the temperature range of "450° C. to 660° C." for 20 seconds to 10 minutes, it is possible to realize the evenness of the microstructure in the same manner as or an improved manner to the method for manufacturing a steel sheet described in the first embodiment.

In the continuous annealing line, a hot-dip galvanizing process, a galvannealing process, a molten aluminum plating process, an alloyed molten aluminum plating process, and an electroplating process can also be performed. The effects of the present invention are not lost even when the plating process is performed after the annealing step.

As shown in the schematic view of FIG. 2, the microstructure of the steel sheet subjected to the cold-rolling step is a non-recrystallized ferrite. In the method for manufacturing of a steel sheet for hot stamping according to the second embodiment, in addition to the first embodiment in which, in the continuous annealing step, by heating to a heating range of "equal to or higher than ($Ac_1$−40)° C. and lower than $Ac_3$° C.", heating is performed until having a double phase coexistence with the austenite phase in which the non-recrystallized ferrite slightly remains, it is possible to lower the heating temperature for even proceeding of the recovery and recrystallization of the ferrite in the coil, even with the heating temperature of $Ac_1$° C. to ($Ac_1$−40)° C. at which the reverse transformation of the austenite does not occur. In addition, by using the hot-rolled sheet showing the even structure, after heating to a temperature of equal to or higher than $Ac_1$° C. and lower than $Ac_3$° C., it is possible to lower the temperature and shorten the time of holding after the cooling at a cooling rate of equal to or less than 10° C./s, compared to the first embodiment. This shows that the ferrite transformation proceeds faster in the cooling step from the austenite by obtaining the even microstructure, and it is possible to sufficiently achieve evenness and softening of the structure, even with the holding conditions of the lower temperature and the short time. That is, in the holding step of holding the steel sheet in the temperature range of "450° C. to 660° C." for 20 seconds to 10 minutes, incrassating of C into the non-transformed austenite occurs at the same time as ferrite transformation, and cementite precipitation or pearlite transformation rapidly occurs by holding in the same temperature range.

From these viewpoints, when the temperature is less than ($Ac_1$−40)° C., since the recovery and the recrystallization of the ferrite is insufficient, it is set as the lower limit, and meanwhile, when the temperature is equal to or higher than $Ac_3$° C., since the ferrite transformation does not sufficiently occur and the strength after the annealing significantly increases by the delay of generation of ferrite nucleation by the B addition effect, it is set as the upper limit. In addition, in the subsequent cooling step at a cooling rate of equal to or less than 10° C./s and the holding step of holding at a temperature range of "450° C. to 660° C." for 20 seconds to 10 minutes, softening is realized by the growth of the ferrite by nucleating the remaining ferrite.

Herein, in the holding step of holding the steel sheet in a temperature range of "450° C. to 660° C." for 20 seconds to 10 minutes, the cementite precipitation or the pearlite transformation can be promoted in the non-transformed austenite in which C is incrassated after the ferrite transformation. Thus, according to the method for manufacturing a steel sheet according to the embodiment, even in a case of heating a material having high hardenability to a temperature right below the $Ac_3$ point by the continuous annealing, most parts of the microstructure of the steel sheet can be set as ferrite and cementite. According to the proceeding state of the transformation, the bainite, the martensite, and the remaining austenite slightly exist after the cooling, in some cases.

In addition, if the temperature in the holding step exceeds 660° C., the proceeding of the ferrite transformation is delayed and the annealing takes long time. On the other hand, when the temperature is lower than 450° C., the ferrite itself which is generated by the transformation is hardened, it is difficult for the cementite precipitation or the pearlite transformation to proceed, or the bainite or the martensite which is the lower temperature transformation product occurs. In addition, when the holding time exceeds 10 minutes, the continuous annealing installation subsequently becomes longer and high cost is necessary, and on the other hand, when the holding time is lower than 20 seconds, the ferrite transformation, the cementite precipitation, or the pearlite transformation is insufficient, the structure is mainly formed of bainite or martensite in which the most parts of the microstructure after the cooling are hardened phase, and the steel sheet is hardened.

FIGS. 3A to 3C show variation in strength of the steel sheet for hot stamping after the continuous annealing with different coiling temperatures for the hot-rolled coil. FIG. 3A shows a case of performing continuous annealing by setting a coiling temperature as 680° C., FIG. 3B shows a case of performing the continuous annealing by setting a coiling temperature as 750° C., that is, in the temperature range of "700° C. to 900° C." (ferrite transformation and pearlite transformation range), and FIG. 3C shows a case of performing continuous annealing by setting a coiling temperature as 500° C., that is, in the temperature range of "25° C. to 500° C." (bainite transformation and martensite transformation range). In FIGS. 3A to 3C, ΔTS indicates variation of the steel sheet (maximum value of tensile strength of steel sheet−minimum value thereof). As clearly shown in FIGS. 3A to 3C, by performing the continuous annealing with suitable conditions, it is possible to obtain even strength and soft hardness of the steel sheet after the annealing.

By using the steel having the even strength, in the hot stamping step, even in a case of employing an electrical-heating method which inevitably generates an irregularity in the steel sheet temperature after heating, it is possible to stabilize the strength of a component of the formed product after the hot stamping. For example, for an electrode holding portion or the like in which the temperature does not rise by the electrical-heating and in which the strength of the material of the steel sheet itself affects the product strength, by evenly managing the strength of the material of the steel sheet itself, it is possible to improve management of precision of the product quality of the formed product after the hot stamping.

Hereinabove, the present invention has been described based on the first embodiment and the second embodiment, however, the present invention is not limited only to the embodiments described above, and various modifications within the scope of the claims can be performed. For example, even in the hot-rolling step or the continuous annealing step of the first embodiment, it is possible to employ the conditions of the second embodiment.

EXAMPLES

Next, Examples of the present invention will be described.

TABLE 1

| Steel type | C | Mn | Si | P | S | N | Al | Ti | B | Cr | $Ac_1$ (° C.) | $Ac_3$ (° C.) | $DI_{inch}$ — |
|---|---|---|---|---|---|---|---|---|---|---|---|---|---|
| | (mass %) | | | | | | | | | | | | |
| A | 0.22 | 1.35 | 0.15 | 0.009 | 0.004 | 0.003 | 0.010 | 0.020 | 0.0012 | 0.22 | 735 | 850 | 4.8 |
| B | 0.22 | 1.65 | 0.03 | 0.009 | 0.004 | 0.004 | 0.010 | 0.010 | 0.0013 | 0.02 | 725 | 840 | 3.5 |
| C | 0.22 | 1.95 | 0.03 | 0.008 | 0.003 | 0.003 | 0.010 | 0.012 | 0.0013 | 0.15 | 725 | 830 | 4.2 |
| D | 0.23 | 2.13 | 0.05 | 0.010 | 0.005 | 0.004 | 0.020 | 0.015 | 0.0015 | 0.10 | 720 | 825 | 5.2 |
| E | 0.28 | 1.85 | 0.10 | 0.008 | 0.004 | 0.003 | 0.015 | 0.080 | 0.0013 | 0.01 | 725 | 825 | 3.8 |
| F | 0.24 | 1.63 | 0.85 | 0.009 | 0.004 | 0.003 | 0.032 | 0.020 | 0.0014 | 0.01 | 740 | 860 | 5.4 |
| G | 0.21 | 2.62 | 0.12 | 0.008 | 0.003 | 0.003 | 0.022 | 0.015 | 0.0012 | 0.10 | 725 | 820 | 8.0 |
| H | 0.16 | 1.54 | 0.30 | 0.008 | 0.003 | 0.003 | 0.020 | 0.012 | 0.0010 | 0.03 | 735 | 850 | 3.4 |
| I | 0.40 | 1.64 | 0.20 | 0.009 | 0.004 | 0.004 | 0.010 | 0.020 | 0.0012 | 0.01 | 730 | 810 | 4.1 |

TABLE 1-continued

| Steel type | C | Mn | Si | P | S | N | Al | Ti | B | Cr | $Ac_1$ (° C.) | $Ac_3$ (° C.) | $DI_{inch}$ — |
|---|---|---|---|---|---|---|---|---|---|---|---|---|---|
| | (mass %) | | | | | | | | | | | | |
| J | 0.21 | 0.82 | 0.13 | 0.007 | 0.003 | 0.003 | 0.021 | 0.020 | 0.0011 | 0.01 | 735 | 865 | 1.8 |
| K | 0.28 | 3.82 | 0.13 | 0.008 | 0.003 | 0.004 | 0.020 | 0.010 | 0.0012 | 0.13 | 710 | 770 | 7.1 |
| L | 0.26 | 1.85 | 1.32 | 0.008 | 0.004 | 0.003 | 0.020 | 0.012 | 0.0015 | 0.01 | 755 | 880 | 9.2 |
| M | 0.29 | 1.50 | 0.30 | 0.008 | 0.003 | 0.004 | 1.300 | 0.020 | 0.0018 | 0.01 | 735 | 1055 | 4.6 |
| N | 0.24 | 1.30 | 0.03 | 0.008 | 0.004 | 0.003 | 0.020 | 0.310 | 0.0012 | 0.20 | 730 | 850 | 4.1 |
| O | 0.22 | 1.80 | 0.04 | 0.009 | 0.005 | 0.003 | 0.010 | 0.020 | 0.0001 | 0.10 | 725 | 830 | 2.2 |
| P | 0.23 | 1.60 | 0.03 | 0.009 | 0.005 | 0.003 | 0.012 | 0.003 | 0.0010 | 0.01 | 725 | 840 | 1.3 |
| Q | 0.21 | 1.76 | 0.13 | 0.009 | 0.004 | 0.003 | 0.021 | 0.020 | 0.0013 | 0.20 | 730 | 835 | 7.5 |
| R | 0.28 | 1.65 | 0.05 | 0.008 | 0.003 | 0.004 | 0.025 | 0.015 | 0.0025 | 0.21 | 725 | 825 | 7.9 |
| S | 0.23 | 2.06 | 0.01 | 0.008 | 0.003 | 0.003 | 0.015 | 0.015 | 0.0022 | 0.42 | 715 | 815 | 8.4 |
| T | 0.22 | 1.60 | 0.15 | 0.008 | 0.004 | 0.003 | 0.022 | 0.015 | 0.0021 | 2.35 | 710 | 810 | 16.1 |

TABLE 2

| Steel type | Mo | Nb | V | Ni | Cu | Sn | Ca | Mg | REM |
|---|---|---|---|---|---|---|---|---|---|
| | (mass %) | | | | | | | | |
| A | 0.05 | | | | | 0.003 | | | |
| B | | | | | | | | | |
| C | | | | | | | | | |
| D | | 0.04 | 0.01 | | 0.008 | | 0.003 | | |
| E | | | | | | | | | |
| F | | 0.06 | | 0.04 | 0.02 | | | | 0.003 |
| G | 0.2 | | 0.005 | | | | | 0.003 | |
| H | | | | | | | | 0.002 | |
| I | | | | | | | | | |
| J | | | | | | | | | |
| K | 0.05 | | | | | | | | |

TABLE 2-continued

| Steel type | Mo | Nb | V | Ni | Cu | Sn | Ca | Mg | REM |
|---|---|---|---|---|---|---|---|---|---|
| | (mass %) | | | | | | | | |
| L | | | | | | | | | 0.002 |
| M | | | | | | | | | |
| N | 0.15 | | | | | | | | |
| O | 0.1 | | | | | | 0.005 | | |
| P | | | | | | | | | |
| Q | 0.11 | | | | | | | | |
| R | 0.15 | 0.08 | | | | 0.002 | | 0.003 | |
| S | | | | | | | | | |
| T | | | | | | | | | |

TABLE 3

| | | Hot-rolling to coiling conditions | | | | | | | Continuous annealing conditions | | | |
|---|---|---|---|---|---|---|---|---|---|---|---|---|
| Steel type | Condition No | $F_4T$ [° C.] | $F_7T$ [° C.] | ($Ac_3$ − 80) [° C.] | ($Ac_3$ + 40) [° C.] | Time from 4 stage to 7 stage [s] | Holding time from 600° C. to $Ar_3$ [s] | CT [° C.] | Highest heating temperature [° C.] | Cooling rate [° C./s] | Holding temperature [° C.] | Holding time [s] |
| A | 1 | 955 | 905 | 770 | 890 | 2.7 | 2.1 | 680 | 830 | 3.5 | 585 | 320 |
| | 2 | 945 | 900 | 770 | 890 | 2.9 | 1.3 | 500 | 825 | 4.2 | 580 | 330 |
| | 3 | 945 | 900 | 770 | 890 | 2.2 | 0.3 | 800 | 830 | 4.1 | 585 | 320 |
| | 4 | 940 | 900 | 770 | 890 | 2.8 | 2.5 | 680 | 700 | 4.3 | 570 | 330 |
| | 5 | 945 | 905 | 770 | 890 | 2.9 | 3.1 | 675 | 870 | 4.5 | 580 | 300 |
| | 6 | 955 | 910 | 770 | 890 | 2.5 | 3.2 | 685 | 820 | 13.5 | 560 | 290 |
| | 7 | 950 | 905 | 770 | 890 | 2.6 | 2.9 | 680 | 825 | 5.2 | 530 | 300 |
| | 8 | 945 | 905 | 770 | 890 | 2.2 | 4.6 | 685 | 810 | 4.6 | 575 | 45 |
| | 9 | 880 | 820 | 770 | 890 | 4.6 | 8.2 | 580 | 810 | 4.2 | 560 | 310 |
| | 10 | 875 | 810 | 770 | 890 | 4.5 | 7.9 | 610 | 710 | 4.3 | 470 | 35 |
| B | 1 | 960 | 890 | 760 | 880 | 2.2 | 4.0 | 650 | 820 | 3.5 | 580 | 290 |
| | 2 | 950 | 895 | 760 | 880 | 2.8 | 1.0 | 500 | 815 | 5 | 560 | 300 |
| | 3 | 945 | 895 | 760 | 880 | 2.6 | 3.0 | 670 | 860 | 4.5 | 560 | 320 |
| | 4 | 945 | 900 | 760 | 880 | 2.9 | 3.0 | 670 | 810 | 5 | 500 | 310 |
| | 5 | 890 | 830 | 760 | 880 | 4.8 | 7.2 | 600 | 805 | 3.9 | 570 | 50 |
| | 6 | 900 | 845 | 760 | 880 | 5.1 | 7.6 | 590 | 705 | 4.5 | 460 | 45 |
| C | 1 | 970 | 905 | 750 | 870 | 2.2 | 4.0 | 650 | 820 | 5.6 | 570 | 300 |
| | 2 | 960 | 910 | 750 | 870 | 2.8 | 4.0 | 680 | 815 | 5.5 | 570 | 290 |
| | 3 | 965 | 915 | 750 | 870 | 2.3 | 4.0 | 680 | 810 | 5.2 | 510 | 280 |
| | 4 | 960 | 910 | 750 | 870 | 3.0 | 3.0 | 680 | 700 | 4.3 | 560 | 300 |
| | 5 | 880 | 800 | 750 | 870 | 5.2 | 7.5 | 610 | 695 | 4.5 | 475 | 28 |
| | 6 | 895 | 820 | 750 | 870 | 4.5 | 6.5 | 590 | 790 | 3.1 | 560 | 32 |
| | 7 | 980 | 930 | 750 | 870 | 2.5 | 2.6 | 720 | 690 | 2.5 | 480 | 35 |
| | 8 | 980 | 820 | 750 | 870 | 6.2 | 7.0 | 590 | 780 | 3.6 | 570 | 25 |
| | 9 | 890 | 810 | 750 | 870 | 4.4 | 6.3 | 600 | 655 | 2.3 | 595 | 30 |
| | 10 | 900 | 830 | 750 | 870 | 4.5 | 6.5 | 580 | 755 | 3.5 | 470 | 5 |

TABLE 4

| | | Hot-rolling to coiling conditions | | | | | | | Continuous annealing conditions | | | |
|---|---|---|---|---|---|---|---|---|---|---|---|---|
| Steel type | Condition No | $F_4T$ [° C.] | $F_7T$ [° C.] | ($Ac_3$ − 80) [° C.] | ($Ac_3$ + 40) [° C.] | Time from 4 stage to 7 stage [s] | Holding time from 600° C. to $Ar_3$ [s] | CT [° C.] | Highest heating temperature [° C.] | Cooling rate [° C./s] | Holding temperature [° C.] | Holding time [s] |
| D | 1 | 950 | 910 | 745 | 865 | 3.2 | 4.0 | 680 | 700 | 2.1 | 500 | 324 |
| | 2 | 960 | 910 | 745 | 865 | 2.1 | 4.0 | 680 | 810 | 4.3 | 580 | 320 |
| | 3 | 965 | 920 | 745 | 865 | 2.0 | 4.0 | 680 | 775 | 1.6 | 580 | 405 |
| | 4 | 960 | 915 | 745 | 865 | 3.3 | 3.0 | 680 | 775 | 2.9 | 540 | 270 |
| | 5 | 965 | 910 | 745 | 865 | 2.3 | 4.0 | 680 | 800 | 2.2 | 540 | 405 |
| | 6 | 975 | 930 | 745 | 865 | 2.9 | 4.0 | 680 | 800 | 4.3 | 500 | 270 |
| | 7 | 960 | 910 | 745 | 865 | 2.1 | 1.0 | 500 | 700 | 2.1 | 680 | 324 |
| | 8 | 950 | 920 | 745 | 865 | 2.1 | 2.0 | 500 | 775 | 1.6 | 580 | 405 |
| | 9 | 950 | 910 | 745 | 865 | 2.2 | 0.0 | 750 | 700 | 2.1 | 550 | 324 |
| | 10 | 955 | 915 | 745 | 865 | 2.3 | 0.0 | 750 | 775 | 1.6 | 580 | 405 |
| E | 1 | 950 | 900 | 745 | 865 | 2.5 | 3.0 | 680 | 800 | 2.3 | 575 | 325 |
| | 2 | 960 | 890 | 745 | 865 | 2.5 | 1.0 | 500 | 805 | 2.5 | 580 | 320 |
| | 3 | 965 | 895 | 745 | 865 | 2.9 | 1.0 | 750 | 795 | 2.8 | 580 | 328 |
| | 4 | 955 | 890 | 745 | 865 | 3.1 | 3.0 | 680 | 840 | 2.5 | 580 | 315 |
| | 5 | 955 | 890 | 745 | 865 | 2.2 | 3.0 | 680 | 800 | 13.5 | 580 | 300 |
| | 6 | 945 | 895 | 745 | 865 | 2.2 | 1.0 | 680 | 800 | 4.2 | 520 | 350 |
| | 7 | 950 | 895 | 745 | 865 | 2.3 | 1.0 | 680 | 795 | 3.5 | 575 | 45 |
| | 8 | 900 | 830 | 745 | 865 | 5.3 | 7.2 | 595 | 785 | 4.2 | 610 | 55 |
| | 9 | 910 | 810 | 745 | 865 | 6.4 | 8.1 | 600 | 700 | 3.9 | 460 | 22 |
| F | 1 | 960 | 910 | 780 | 900 | 2.2 | 2.2 | 675 | 840 | 4.6 | 560 | 325 |
| | 2 | 950 | 900 | 780 | 900 | 2.1 | 2.3 | 675 | 830 | 4.3 | 585 | 520 |
| | 3 | 950 | 920 | 780 | 900 | 2.1 | 3.0 | 450 | 835 | 3.5 | 580 | 320 |
| | 4 | 960 | 900 | 780 | 900 | 1.8 | 1.0 | 775 | 825 | 3.5 | 575 | 350 |
| | 5 | 950 | 905 | 780 | 900 | 1.9 | 1.5 | 685 | 730 | 3.6 | 580 | 305 |

TABLE 5

| | | Hot-rolling to coiling conditions | | | | | | | Continuous annealing conditions | | | |
|---|---|---|---|---|---|---|---|---|---|---|---|---|
| Steel type | Condition No | $F_4T$ [° C.] | $F_7T$ [° C.] | ($Ac_3$ − 80) [° C.] | ($Ac_3$ + 40) [° C.] | Time from 4 stage to 7 stage [s] | Holding time from 600° C. to $Ar_3$ [s] | CT [° C.] | Highest heating temperature [° C.] | Cooling rate [° C./s] | Holding temperature [° C.] | Holding time [s] |
| G | 1 | 960 | 905 | 740 | 860 | 2.2 | 2.5 | 680 | 800 | 3.8 | 555 | 320 |
| | 2 | 970 | 910 | 740 | 860 | 2.5 | 2.6 | 680 | 805 | 4.2 | 585 | 545 |
| | 3 | 950 | 910 | 740 | 860 | 2.6 | 2.4 | 400 | 800 | 4.1 | 575 | 320 |
| | 4 | 950 | 915 | 740 | 860 | 2.3 | 2.2 | 800 | 790 | 3.5 | 580 | 315 |
| | 5 | 955 | 920 | 740 | 860 | 2.5 | 2.3 | 680 | 710 | 3.5 | 580 | 295 |
| H | 1 | 960 | 915 | 770 | 890 | 2.4 | 2.1 | 685 | 830 | 4.2 | 580 | 305 |
| | 2 | 955 | 920 | 770 | 890 | 2.5 | 2.5 | 680 | 760 | 4.1 | 550 | 310 |
| I | 1 | 950 | 905 | 730 | 850 | 2.6 | 2.1 | 675 | 800 | 3.2 | 580 | 290 |
| | 2 | 955 | 900 | 730 | 850 | 2.7 | 2.5 | 670 | 790 | 2.8 | 540 | 285 |
| J | 1 | 945 | 905 | 785 | 905 | 2.8 | 2.1 | 680 | 840 | 3.5 | 580 | 300 |
| | 2 | 950 | 910 | 785 | 905 | 2.6 | 2.1 | 685 | 750 | 3.8 | 530 | 310 |
| K | 1 | — | — | 690 | 810 | 2.9 | — | — | — | — | — | — |
| L | 1 | 960 | 920 | 800 | 920 | 2.3 | 2.5 | 680 | 850 | 5.2 | 560 | 300 |
| M | 1 | 960 | 910 | 975 | 1095 | 2.5 | 4.0 | 680 | 860 | 4.5 | 580 | 305 |
| N | 1 | — | — | 770 | 890 | — | — | — | — | — | — | — |
| O | 1 | 960 | 910 | 750 | 870 | 2.9 | 2.1 | 670 | 810 | 3.5 | 580 | 305 |
| | 2 | 965 | 905 | 750 | 870 | 2.5 | 2.1 | 680 | 750 | 4.2 | 520 | 310 |
| P | 1 | 970 | 930 | 760 | 880 | 2.9 | 2.3 | 680 | 820 | 4.5 | 580 | 300 |
| Q | 1 | 960 | 910 | 755 | 875 | 2.1 | 2.5 | 680 | 810 | 5 | 575 | 310 |
| R | 1 | 940 | 905 | 745 | 865 | 2.2 | 2.1 | 610 | 785 | 4.2 | 575 | 305 |
| S | 1 | 945 | 910 | 735 | 855 | 2.4 | 2.2 | 605 | 795 | 3.2 | 585 | 295 |
| T | 1 | — | — | 730 | 850 | — | — | — | — | — | — | — |

TABLE 6

| | | Material | | Microstructure | | | | |
|---|---|---|---|---|---|---|---|---|
| | | | | | Non-crystallized | Non-segmentalized | | |
| Steel type | Condition No. | ΔTS [MPa] | TS_Ave [MPa] | Ferrite fraction [vol. %] | ferrite fraction [vol. %] | pearlite fraction [vol. %] | $Cr_\theta/Cr_M$ — | $Mn_\theta/Mn_M$ — |
| A | 1 | 60 | 620 | 65 | 10 | 25 | 1.3 | 8.2 |
| | 2 | 40 | 590 | 75 | 5 | 20 | 1.5 | 8.1 |
| | 3 | 35 | 580 | 65 | 5 | 30 | 1.4 | 7.5 |
| | 4 | 150 | 750 | 45 | 55 | 0 | 3.2 | 14.3 |
| | 5 | 55 | 760 | 20 | 0 | 0 | 1.5 | 7.5 |
| | 6 | 60 | 720 | 35 | 5 | 0 | 1.2 | 8.7 |
| | 7 | 90 | 710 | 45 | 5 | 5 | 1.3 | 7.3 |
| | 8 | 55 | 720 | 40 | 10 | 5 | 1.5 | 7.8 |
| | 9 | 30 | 580 | 75 | 5 | 20 | 1.3 | 7.9 |
| | 10 | 55 | 640 | 85 | 5 | 10 | 1.5 | 7.5 |
| B | 1 | 60 | 600 | 70 | 5 | 15 | 1.4 | 8.9 |
| | 2 | 30 | 590 | 65 | 10 | 15 | 1.2 | 8.4 |
| | 3 | 85 | 700 | 35 | 0 | 0 | 1.5 | 8.8 |
| | 4 | 95 | 690 | 45 | 10 | 5 | 1.3 | 8.2 |
| | 5 | 35 | 585 | 70 | 10 | 15 | 1.5 | 8.2 |
| | 6 | 45 | 635 | 80 | 5 | 10 | 1.6 | 8.5 |
| C | 1 | 60 | 610 | 65 | 10 | 15 | 1.2 | 7.8 |
| | 2 | 65 | 605 | 70 | 15 | 15 | 1.4 | 8.2 |
| | 3 | 105 | 705 | 45 | 10 | 5 | 1.4 | 8.8 |
| | 4 | 150 | 685 | 40 | 60 | 0 | 3.3 | 12.8 |
| | 5 | 40 | 645 | 80 | 10 | 10 | 2.2 | 9.4 |
| | 6 | 35 | 620 | 70 | 5 | 25 | 1.2 | 8.1 |
| | 7 | 95 | 730 | 40 | 60 | 0 | 3.5 | 11.9 |
| | 8 | 115 | 725 | 35 | 10 | 10 | 1.4 | 8.2 |
| | 9 | 85 | 820 | 5 | 95 | 0 | 2.2 | 9.6 |
| | 10 | 45 | 735 | 60 | 15 | 5 | 1.2 | 7.5 |

TABLE 7

| | | Material | | Microstructure | | | | |
|---|---|---|---|---|---|---|---|---|
| | | | | | Non-crystallized | Non-segmentalized | | |
| Steel type | Condition No. | ΔTS [MPa] | TS_Ave [MPa] | Ferrite fraction [vol. %] | ferrite fraction [vol. %] | pearlite fraction [vol. %] | $Cr_\theta/Cr_M$ — | $Mn_\theta/Mn_M$ — |
| D | 1 | 166 | 690 | 40 | 55 | 5 | 3.5 | 13.2 |
| | 2 | 62 | 610 | 70 | 10 | 20 | 1.2 | 7.6 |
| | 3 | 70 | 620 | 65 | 20 | 15 | 1.5 | 8.1 |
| | 4 | 73 | 690 | 45 | 15 | 5 | 1.2 | 7.9 |
| | 5 | 58 | 680 | 40 | 10 | 5 | 1.4 | 8.2 |
| | 6 | 120 | 720 | 40 | 10 | 0 | 1.1 | 7.4 |
| | 7 | 100 | 700 | 40 | 60 | 0 | 3.2 | 12.2 |
| | 8 | 28 | 630 | 65 | 15 | 15 | 1.5 | 9.4 |
| | 9 | 115 | 700 | 40 | 60 | 0 | 2.9 | 11.5 |
| | 10 | 46 | 620 | 65 | 10 | 10 | 1.2 | 8.5 |
| E | 1 | 80 | 685 | 75 | 10 | 15 | 1.5 | 8.6 |
| | 2 | 60 | 680 | 70 | 20 | 10 | 1.2 | 7.8 |
| | 3 | 55 | 675 | 65 | 25 | 10 | 1.1 | 8.2 |
| | 4 | 80 | 810 | 40 | 0 | 0 | 1.5 | 9.1 |
| | 5 | 80 | 760 | 30 | 20 | 0 | 1.3 | 8.8 |
| | 6 | 90 | 840 | 45 | 20 | 5 | 1.4 | 8.5 |
| | 7 | 80 | 950 | 45 | 15 | 5 | 1.2 | 7.5 |
| | 8 | 40 | 630 | 65 | 10 | 15 | 1.3 | 8.8 |
| | 9 | 35 | 610 | 70 | 30 | 0 | 2.2 | 9.6 |
| F | 1 | 70 | 640 | 65 | 10 | 15 | 1.5 | 7.6 |
| | 2 | 50 | 610 | 60 | 10 | 20 | 1.2 | 7.8 |
| | 3 | 45 | 600 | 70 | 5 | 15 | 1.3 | 8.2 |
| | 4 | 40 | 605 | 75 | 10 | 15 | 1.5 | 7.5 |
| | 5 | 135 | 680 | 45 | 55 | 0 | 2.5 | 13.5 |

TABLE 8

| Steel type | Condition No. | Material ΔTS [MPa] | Material TS_Ave [MPa] | Microstructure: Ferrite fraction [vol. %] | Microstructure: Non-crystallized ferrite fraction [vol. %] | Microstructure: Non-segmentalized pearlite fraction [vol. %] | $Cr_\theta/Cr_M$ — | $Mn_\theta/Mn_M$ — |
|---|---|---|---|---|---|---|---|---|
| G | 1 | 70 | 635 | 60 | 30 | 10 | 1.3 | 9.2 |
| | 2 | 55 | 605 | 65 | 20 | 15 | 1.4 | 8.9 |
| | 3 | 40 | 620 | 65 | 20 | 15 | 1.4 | 8.5 |
| | 4 | 40 | 610 | 60 | 20 | 20 | 1.6 | 8.8 |
| | 5 | 165 | 695 | 40 | 60 | 0 | 2.2 | 13.2 |
| H | 1 | 70 | 620 | 80 | 10 | 10 | 1.8 | 9.3 |
| | 2 | 105 | 680 | 80 | 20 | 0 | 2.5 | 13.3 |
| I | 1 | 130 | 830 | 65 | 15 | 20 | 1.2 | 7.5 |
| | 2 | 150 | 850 | 45 | 10 | 15 | 1.5 | 8.2 |
| J | 1 | 50 | 580 | 75 | 15 | 10 | 1.3 | 8.5 |
| | 2 | 60 | 585 | 45 | 40 | 15 | 1.6 | 11.9 |
| K | 1 | — | — | — | — | — | — | — |
| L | 1 | 70 | 650 | 65 | 25 | 10 | 1.6 | 9.2 |
| M | 1 | 140 | 760 | 70 | 10 | 20 | 1.7 | 8.5 |
| N | 1 | — | — | — | — | — | — | — |
| O | 1 | 30 | 610 | 70 | 20 | 10 | 1.5 | 6.8 |
| | 2 | 55 | 600 | 75 | 10 | 15 | 1.6 | 7.5 |
| P | 1 | 30 | 600 | 75 | 15 | 10 | 1.3 | 8.5 |
| Q | 1 | 30 | 595 | 65 | 20 | 15 | 1.3 | 8.9 |
| R | 1 | 65 | 705 | 60 | 10 | 30 | 1.8 | 9.2 |
| S | 1 | 35 | 605 | 75 | 10 | 15 | 1.5 | 9.3 |
| T | 1 | — | — | — | — | — | — | — |

TABLE 9

| Steel type | condition No. | Plating type | Variation of hardness of non-hardened portion: ΔHv | Variation of hardness of non-hardened portion: Hv_Ave | Hardness of non-hardened portion | Chemical conversion coating Hv | Note |
|---|---|---|---|---|---|---|---|
| A | 1 | hot-dip galvanizing | 18 | 190 | 462 | Good | |
| | 2 | galvannealing | 12 | 181 | 468 | Good | |
| | 3 | hot-dip galvanizing | 11 | 178 | 465 | Good | |
| | 4 | — | 46 | 230 | 462 | Good | Non-recrystallized ferrite remaining |
| | 5 | — | 17 | 233 | 456 | Good | Insufficient ferrite transformation and cementite precipitation |
| | 6 | — | 18 | 220 | 459 | Good | Insufficient ferrite transformation |
| | 7 | — | 28 | 217 | 471 | Good | Insufficient ferrite transformation and cementite precipitation |
| | 8 | — | 17 | 220 | 468 | Good | Insufficient ferrite transformation and cementite precipitation |
| | 9 | — | 21 | 179 | 465 | Good | |
| | 10 | — | 19 | 196 | 458 | Good | |
| B | 1 | hot-dip galvanizing | 18 | 184 | 468 | Good | |
| | 2 | molten aluminum plating | 9 | 181 | 468 | Good | |
| | 3 | — | 26 | 214 | 471 | Good | Insufficient ferrite transformation and cementite precipitation |
| | 4 | — | 29 | 211 | 468 | Good | Insufficient ferrite transformation and cementite precipitation |
| | 5 | hot-dip galvanizing | 21 | 180 | 478 | Good | |
| | 6 | — | 23 | 195 | 475 | Good | |
| C | 1 | hot-dip galvanizing | 18 | 187 | 474 | Good | |
| | 2 | hot-dip galvanizing | 20 | 185 | 478 | Good | |
| | 3 | — | 32 | 216 | 481 | Good | Insufficient ferrite transformation and cementite precipitation |
| | 4 | — | 46 | 210 | 474 | Good | Non-recrystallized ferrite remaining |
| | 5 | galvannealing | 12 | 197 | 466 | Good | |
| | 6 | — | 15 | 187 | 468 | Good | |
| | 7 | hot-dip galvanizing | 53 | 224 | 461 | Good | Insufficient ferrite transformation and cementite precipitation |
| | 8 | — | 42 | 223 | 475 | Good | Insufficient ferrite transformation and cementite precipitation |
| | 9 | — | 43 | 250 | 485 | Good | Insufficient ferrite recrystallization |
| | 10 | — | 48 | 220 | 495 | Good | Insufficient cementite precipitation |

TABLE 10

| Steel type | Condition No. | Plating type | Variation of hardness of non-hardened portion ΔHv | Hv_Ave | Hardness of non-hardened portion | Chemical conversion coating Hv | Note |
|---|---|---|---|---|---|---|---|
| D | 1 | — | 51 | 211 | 468 | Good | Non-recrystallized ferrite remaining |
| | 2 | — | 19 | 187 | 474 | Good | |
| | 3 | hot-dip galvanizing | 21 | 190 | 478 | Good | |
| | 4 | — | 22 | 211 | 474 | Good | Insufficient ferrite transformation and cementite precipitation |
| | 5 | — | 18 | 208 | 478 | Good | Insufficient ferrite transformation and cementite precipitation |
| | 6 | — | 37 | 220 | 481 | Good | Insufficient ferrite transformation and cementite precipitation |
| | 7 | — | 31 | 214 | 479 | Good | Insufficient ferrite transformation |
| | 8 | electroplating | 9 | 193 | 474 | Good | |
| | 9 | — | 35 | 214 | 481 | Good | Insufficient ferrite transformation and cementite precipitation |
| | 10 | — | 14 | 190 | 478 | Good | |
| E | 1 | — | 24 | 210 | 539 | Good | |
| | 2 | hot-dip galvanizing | 18 | 208 | 542 | Good | |
| | 3 | hot-dip galvanizing | 17 | 207 | 539 | Good | |
| | 4 | — | 24 | 248 | 545 | Good | Insufficient ferrite transformation and cementite precipitation |
| | 5 | — | 24 | 233 | 539 | Good | Insufficient ferrite transformation |
| | 6 | — | 28 | 257 | 536 | Good | Insufficient ferrite transformation and cementite precipitation |
| | 7 | — | 24 | 291 | 539 | Good | Insufficient ferrite transformation and cementite precipitation |
| | 8 | — | 13 | 191 | 521 | Good | |
| | 9 | — | 15 | 185 | 533 | Good | |
| F | 1 | alloyed molten aluminum plating | 21 | 196 | 478 | Good | |
| | 2 | — | 15 | 187 | 481 | Good | |
| | 3 | hot-dip galvanizing | 14 | 184 | 481 | Good | |
| | 4 | hot-dip galvanizing | 12 | 185 | 484 | Good | |
| | 5 | — | 40 | 202 | 484 | Good | Non-recrystallized ferrite remaining |

TABLE 11

| Steel type | Condition No. | Plating type | Variation of hardness of non-hardened portion ΔHv | Hv_Ave | Hardness of non-hardened portion | Chemical conversion coating Hv | Note |
|---|---|---|---|---|---|---|---|
| G | 1 | — | 21 | 194 | 465 | Good | |
| | 2 | electroplating | 17 | 185 | 468 | Good | |
| | 3 | — | 12 | 190 | 465 | Good | |
| | 4 | hot-dip galvanizing | 12 | 187 | 456 | Good | |
| | 5 | — | 47 | 208 | 456 | Good | Non-recrystallized ferrite remaining |
| H | 1 | — | 21 | 190 | 349 | Good | Strength after hot stamping is less than 1180 MPa |
| | 2 | — | 32 | 208 | 346 | Good | |
| I | 1 | — | 40 | 254 | — | Good | Cracks on end portion are generated at the time of hot stamping forming |
| | 2 | — | 46 | 260 | — | Good | |
| J | 1 | — | 15 | 178 | 383 | Good | ΔHv is in the range even with the method of the related art for low hardenability. |
| | 2 | — | 18 | 179 | 386 | Good | |
| K | 1 | — | — | — | — | Good | Hot-rolling is difficult |
| L | 1 | — | 21 | 199 | 484 | Poor | Poor chemical conversion coating |
| M | 1 | — | 43 | 233 | 545 | Poor | Poor chemical conversion coating |
| N | 1 | — | — | — | — | Good | Hot-rolling is difficult |
| O | 1 | — | 9 | 187 | 383 | Good | ΔHv is in the range even with the method of the related art for low hardenability. |
| | 2 | — | 17 | 184 | 380 | Good | |
| P | 1 | — | 9 | 184 | 386 | Good | ΔHv is in the range even with the method of the related art fol- |
| Q | 1 | hot-dip galvanizing | 9 | 182 | 468 | Good | low hardenability. |
| R | 1 | — | 19 | 216 | 513 | Good | |
| S | 1 | — | 12 | 186 | 466 | Good | |
| T | 1 | — | — | — | — | — | Hot-rolling is difficult |

Figure 5:
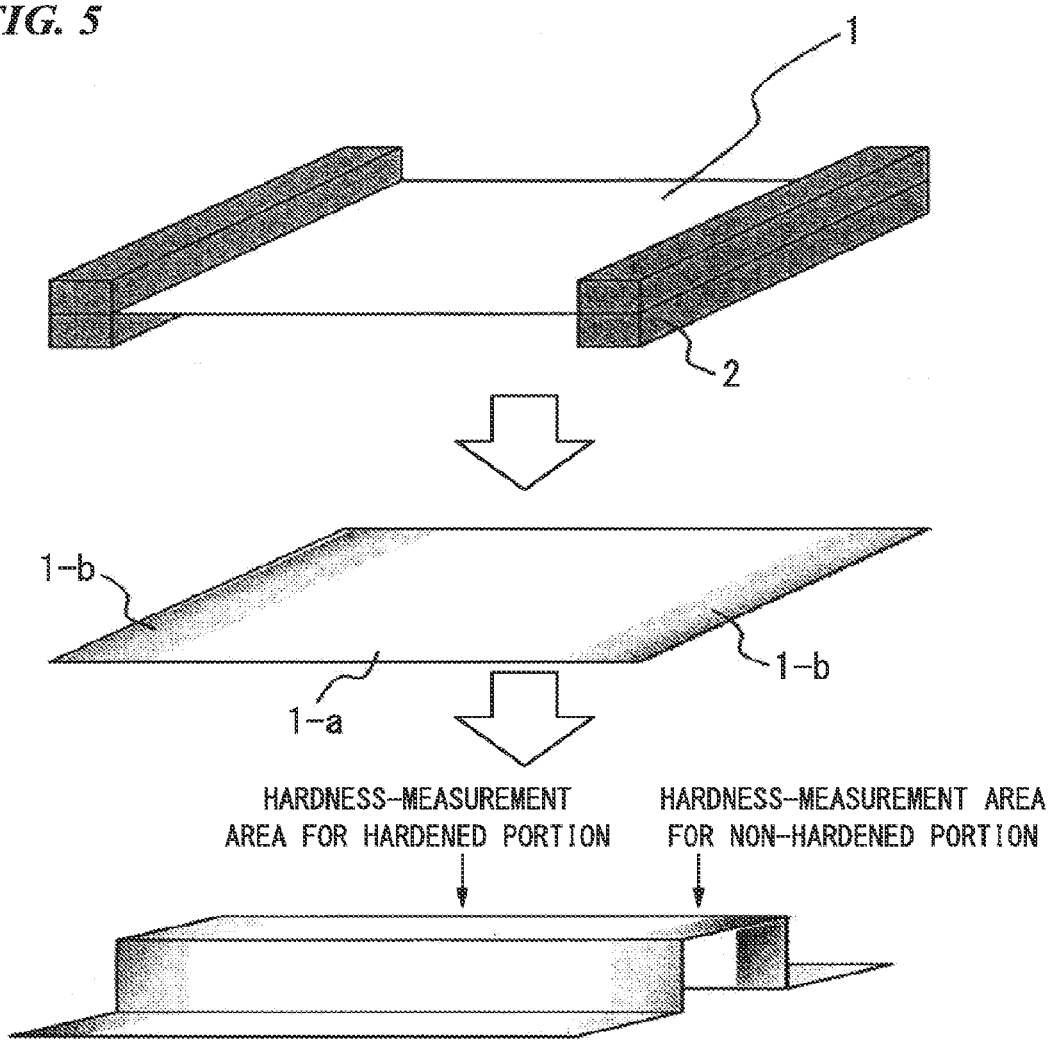
FIG. 5 is a view showing hot stamping steps of example of the present invention.

A steel having steel material components shown in Table 1 and Table 2 was smelted and prepared, heated to 1200° C., rolled, and coiled at a coiling temperature CT shown in Tables 3 to 5, a steel strip having a thickness of 3.2 mm being manufactured. The rolling was performed using a hot-rolling line including seven finishing rolling mills. Tables 3 to 5 show a "steel type", a "condition No.", "hot-rolling to coiling conditions", and a "continuous annealing condition". $Ac_1$ and $Ac_3$ were experimentally measured using a steel sheet having a thickness of 1.6 mm which was obtained by rolling with a cold-rolling rate of 50%. For the measurement of $Ac_1$ and $Ac_3$, measurement was performed from an expansion and contraction curve by formaster, and values measured at a heating rate of 5° C./s are disclosed in Table 1. The continuous annealing was performed for the steel strip at a heating rate of 5° C./s with conditions shown in Tables 3 to 5. In addition, in Tables 6 to 8, "strength variation (ΔTS)", a "strength average value (TS_Ave)", a "microstructure of a steel strip", "$Cr_\theta/Cr_M$", and "$Mn_\theta/Mn_M$" acquired based on tensile strength measured from 10 portions of the steel strip after the continuous annealing are shown. The fraction of the microstructure shown in Tables 6 to 8 was obtained by observing the cut and polished test piece with the optical microscope and measuring the ratio using a point counting method. After that, as shown in FIG. 5, an electrical-heating was performed using an electrode 2 with respect to the steel sheet 1 for hot press, thereby heating the steel sheet for hot press so that a heated portion 1-*a* and a non-heated portion 1-*b* co-exist in the steel sheet. Then, hot stamping was performed. The heated portion 1-*a* is heated at the heating rate of 30° C./s until the temperature reaches $Ac_3$+50° C., and then, without performing temperature holding after the heating, the die was cooled at the cooling rate of not less than 20° C./s. The hardness of the non-heated portion 1-*b* as shown in FIG. 5 was measured by obtaining average value of five points using Vickers hardness tester with 5 kgf load, at the cross section in the 0.4 mm depth from the surface. With respect to the hot-rolled coil, 30 parts are selected at random and the difference between the maximum hardness and the minimum hardness was obtained as ΔHv, and the average thereof was obtained as Hv_Ave. The threshold value of the ΔHv is significantly affected by the amount of C of the steel material, thus, the present invention employs the following criteria for the threshold value.

If the amount of C in the steel sheet is equal to or more than 0.18% and less than 0.25%, ΔHv≤25 and Hv_Ave≤200.

If the amount of C in the steel sheet is equal to or more than 0.25% and less than 0.3%, ΔHv≤32 and Hv_Ave≤220.

If the amount of C in the steel sheet is equal to or more than 0.3% and less than 0.35%, ΔHv≤38 and Hv_Ave≤240.

In the tensile test, steel sheet samples were extracted from portions within 20 m from the initial location and final location of the steel strip, and the tensile strength was acquired by performing tensile tests in the rolling direction to obtain values of the tensile strength at respective 5 portions in the width direction as measurement portions.

As to the hardenability, if the chemical components are out of the range of the present invention, the hardenability is low and thus, the variation of the hardness or the rising of the hardness in the steel sheet manufacturing as described in the opening of this specification does not occur. Accordingly, when the hardness of the non-heated portion of the component is measured after hot stamping, low hardness and low variation of the hardness can be stably obtained even if the present invention is not employed. Therefore, this is regarded as out of the invention. More specifically, a product manufactured by employing a condition which is out of the range of the present invention but satisfies the above-mentioned threshold value of ΔHv is regarded as out of the present invention.

Figure 4:
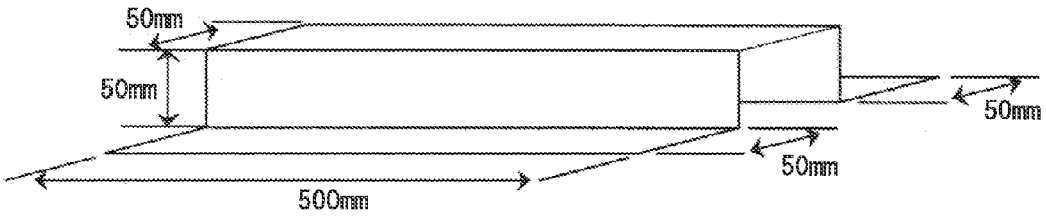
FIG. 4 is a view showing a shape of a hot stamped product of example of the present invention.

Then, using a press die and a piece of steel sheet which was cut from the manufactured steel sheet and electrically-heated with electrodes schematically shown in FIG. 5, hot stamping was performed, thereby manufacturing a hot-stamped component with a shape as illustrated in FIG. 4. In the hot stamping, the heating rate of the center portion was set to be 50° C./s and the steel sheet was heated to the highest heating temperature of 870° C. The end portion of the steel sheet was a non-heated portion since the temperature of the electrode was about a room temperature. In order to easily generate a temperature variation in the steel sheet depending on the areas of the steel sheet, as shown in FIG. 4, a steel sheet electrically-heated with an electrical-heating electrode unit through which a cooling medium passes was pressed. The die used in pressing was a hat-shaped die, and R with a type of punch and die was set as 5R. In addition, a height of the vertical wall of the hat was 50 mm and blank hold pressure was set as 10 tons.

Further, since it is a precedent condition to use a material for hot stamping in the present invention, a case where the maximum hardness at the hardened portion after hot stamping becomes less than Hv 400 is regarded as out of the invention. The maximum hardness of the hardened portion was measured at "HARDNESS-MEASUREMENT AREA FOR HARDENED PORTION" as shown in FIG. 5 where the steel sheet is heated to $Ac_3$ or more and is in close contact with the die. The hardness measurement was conducted for 30 components to obtain the average value as similar to the hardness measurement of the non-heated portion as mentioned above.

For the chemical conversion coating, a phosphate crystal state was observed with five visual fields using a scanning electron microscope with 10000 magnification by using dip-type bonderised liquid which is normally used, and was determined as a pass if there was no clearance in a crystal state (Pass: Good, Failure: Poor).

Test Examples A-1, A-2, A-3, B-1, B-2, B-5, B-6, C-1, C-2, C-5, C-6, D-2, D-3, D-8, D-10, E-1, E-2, E-3, E-8, E-9, F-1, F-2, F-3, F-4, G-1, G-2, G-3, G-4, Q-1, R-1, and S-1 were determined to be good since they were in the range of the conditions. In Test Examples A-4, C-4, D-1, D-9, F-5, and G-5, since the highest heating temperature in the continuous annealing was lower than the range of the present invention, the non-recrystallized ferrite remained and ΔHv became high. In Test Examples A-5, B-3, and E-4, since the highest heating temperature in the continuous annealing was higher than the range of the present invention, the austenite single phase structure was obtained at the highest heating temperature, and the ferrite transformation and the cementite precipitation in the subsequent cooling and the holding did not proceed, the hard phase fraction after the annealing became high, and Hv_Ave became high. In Test Examples A-6 and E-5, since the cooling rate from the highest heating temperature in the continuous annealing was higher than the range of the present invention, the ferrite transformation did not sufficiently occur and ΔHv_Ave became high. In Test Examples A-7, D-4, D-5, D-6, and E-6, since the holding temperature in the continuous annealing was lower than the range of the present invention, the ferrite transformation and the cementite precipitation were insufficient, and Hv_Ave became high. In Test Example D-7, since the holding temperature in the continuous annealing was higher than the range of the present invention, the ferrite transformation did not sufficiently proceed, and Hv_Ave became high. In Test Examples A-8 and E-7, since the holding time in the continuous annealing was shorter than the range of the present invention, the ferrite transformation and the cementite precipitation were insufficient, and ΔHv_Ave became high. When comparing Test Examples B-1, C-2, and D-2 and Test Examples B-4, C-3, and D-6 which have similar manufacturing conditions in the steel type having almost same concentration of C of the steel material and having different $DI_{inch}$ values of 3.5, 4.2 and 5.2, it was found that, when the $DI_{inch}$ value was large, improvement of ΔHv and Hv_Ave was significant. Since a steel type H had a small amount of C of 0.16%, the hardness after quenching in the hot stamping became lower, and it was not suitable as a hot stamped component. Since a steel type I had a large amount of C of 0.40%, the formability of the non-heated portion was generated at the time of hot stamping. A steel type J had a small amount of Mn of 0.82%, and the hardenability was low. Since steel types K and N respectively had a large amount of Mn of 3.82% and Ti of 0.310%, it was difficult to perform the hot-rolling which is a part of a manufacturing step of a hot stamped component. Since steel types L and M respectively had a large amount of Si of 1.32% and Al of 1.300%, the chemical conversion coating of the hot stamped component was degraded. Since a steel type O had a small added amount of B and a steel type P had insufficient detoxicating of N due to Ti addition, the hardenability was low.

In addition, as found from Tables 3 to 11, although the surface treatment due to plating or the like was performed, the effects of the present invention were not disturbed.

INDUSTRIAL APPLICABILITY

According to the present invention, it is possible to provide a method for manufacturing a hot stamped body which can suppress a variation in hardness at a non-hardened portion even if a steel sheet which is heated so as to have a heated portion and a non-heated portion is hot stamped, and a hot stamped body which has a small variation in hardness at the non-hardened portion.

The invention claimed is:

1. A hot stamped body, which is formed by performing hot stamping by heating a steel sheet so that a heated portion at which a highest heating temperature is equal to or higher than $Ac_3$° C., and a non-heated portion at which a highest heating temperature is equal to or lower than Ac1° C. co-exist in the steel sheet, the steel sheet being a steel sheet for hot stamping which is continuously annealed, the hot stamped body containing chemical components which include, by mass %, 0.18% to 0.35% of C, 1.0% to 3.0% of Mn, 0.01% to 1.0% of Si, 0.001% to 0.02% of P, 0.0005% to 0.01% of S, 0.001% to 0.01% of N, 0.01% to 1.0% of Al, 0.005%% to 0.2% of Ti, 0.0002% to 0.005% of B, and 0.002% to 2.0% of Cr, and the balance of Fe and inevitable impurities, wherein:

when the amount of C in the hot stamped body is equal to or more than 0.18% and less than 0.25%, ΔHv is equal to or less than 25 and Hv_Ave is equal to or less than 200;

when the amount of C in the hot stamped body is equal to or more than 0.25% and less than 0.30%, ΔHv is equal to or less than 32 and Hv_Ave is equal to or less than 220; and when the amount of C in the hot stamped body is equal to or more than 0.30% and less than 0.35%, ΔHv is equal to or less than 38 and Hv_Ave is equal to or less than 240, wherein ΔHv represents a variation in Vickers hardness of the non-heated portion, and Hv_Ave represents an average Vickers hardness of the non-heated portion.

* * * * *